US006283897B1

(12) United States Patent
Patton

(10) Patent No.: US 6,283,897 B1
(45) Date of Patent: Sep. 4, 2001

(54) ANKLE AND HIP STRENGTHENING APPARATUS

(76) Inventor: Blair R. Patton, 304 7th Ave. South, Lewistown, MT (US) 59457

( * ) Notice: Subject to any disclaimer, the term of this patent is extended or adjusted under 35 U.S.C. 154(b) by 0 days.

(21) Appl. No.: 09/556,678

(22) Filed: Apr. 21, 2000

Related U.S. Application Data

(60) Provisional application No. 60/130,657, filed on Apr. 23, 1999.

(51) Int. Cl.[7] ..... A63B 21/02

(52) U.S. Cl. ..... 482/79; 482/80; 482/124

(58) Field of Search ..... 482/120, 79, 80, 482/134, 129, 121, 123; 36/7.5, 7.6, 8.1

(56) References Cited

U.S. PATENT DOCUMENTS 5,035,421 * 7/1991 Scheller ..... 482/79

6,063,013 * 5/2000 Vathappallil ..... 482/121

* cited by examiner

*Primary Examiner*—Jerome Donnelly
(74) *Attorney, Agent, or Firm*—Richard C. Litman

(57) ABSTRACT

An ankle and hip exercising apparatus for exercising the ankle and hip using dorsi ankle flexion, plantar ankle flexion, ankle rotation, and hip rotation. The user may use unidirectional resistance for strength and range of motion development, or bidirectional resistance to develop proprioception. The foot is held in place by an overshoe having a sole with divots, mating with a shaft having a rounded top. Resistance is provided by elastomeric resistance members such as surgical tubing. The ankle exerciser's base board includes angle measurement indicia to provide feedback for range of motion improvement. A unique combination disc and hemispherical ball support is used to distribute weight which produces stress about the ankle in various areas of the foot. The device may be used while sitting or standing, depending on the type of exercise desired.

20 Claims, 22 Drawing Sheets

ANKLE AND HIP STRENGTHENING APPARATUS

CROSS-REFERENCE TO RELATED APPLICATION

This application claims the benefit of U.S. Provisional Patent Application Serial No. 60/130,657, filed Apr. 23, 1999.

BACKGROUND OF THE INVENTION

1. Field of the Invention

The present invention relates generally to exercising devices.

More specifically, the invention is an ankle and hip exercising device which utilizes surgical tubing in combination with a multi-purpose shoe support to provide unidirectional and bidirectional resistance to foot movement.

2. Description of Related Art

Physical therapists and athletic trainers have long recognized the need for developing the strength, range of motion, and proprioception of the ankle and hips. Several other inventors have proposed various devices to meet this need. However, no other device within the knowledge of the present inventor combines all of the advantages of the present invention. Specifically, no other device provides for dorsi flexion, plantar flexion, ankle rotation, and hip rotation; allows for development of proprioception through the use of bidirectional forces; and provides angle measurement indicia to show the user and therapist the degree of progress.

One example of a prior foot exercise device is U.S. Pat. No. 1,509,793, issued to Ralph S. Thompson on Sep. 23, 1924, describing a foot exercise apparatus having a foot support mounted on a ball and socket joint. A spring provides resistance. A pair of shafts attached to the foot support moves within a generally vertical curved channel, limiting the motion to that which will exercise the desired muscles while avoiding stress on other muscles.

U.S. Pat. No. 2,645,482, issued to Herbert N. Magida on Jul. 14, 1953, describes a foot actuated exercise apparatus having a foot support pivotally mounted to a telescoping tube at the heel portion, and pivotally and slidably mounted to a rod attached to a rotating disk. The rotating disk includes a thumb screw for changing the level of friction. The exercise is performed by using the foot to rotate the disk in a complete circle.

U.S. Pat. No. 2,760,774, issued to Willy M. Perez on Aug. 28, 1956, describes a foot exerciser. The foot exerciser has a plate with a pair of heel supports attached to one side, and a pair of spring-biased toe-receiving members on the other side. The user exercises by attempting to move the feet closer together against the force of the springs.

U.S. Pat. No. 4,573,678, issued to Steve Lamb et al. on Mar. 4, 1986, describes a lower extremity muscle conditioning device. The device is a platform shoe having a platform pivotally mounted to the base at the heel, for elevating the toes higher than the heel. The invention is claimed to stretch the lower extremity muscles while walking.

U.S. Pat. No. 4,605,220, issued to Tim L. Troxel on Aug. 12, 1986, describes an ankle exerciser. The ankle exerciser has a foot plate mounted on a universal joint, and having shock absorbers on all 4 sides to provide resistance. Sliding the shock absorber's connector closer or farther from the universal joint varies the resistance provided by the shock absorber.

U.S. Pat. No. 4,767,118, issued to Doak Ostergard on Aug. 30, 1988, describes an ankle exercising device having a foot receiving portion and a resistance portion. The resistance portion is a flat plate with perpendicular walls on 3 sides. Moving the exercising device through water causes the water to resist the movement of the resistance portion.

U.S. Pat. No. 5,100,129, issued to E. Illene Porter et al. on Mar. 31, 1992, describes a lower leg exercise device including a foot harness and a length of surgical tubing. The surgical tubing extends from the foot harness to a piece of furniture.

U.S. Pat. No. 5,178,596, issued to Nora L. McIntire on Jan. 12, 1993, describes an exercise device. The exercise device includes a base plate, a pair of foot plates which are hingedly attached to the base plate at the heel portion, and spring-biased away from the base plate at the ball of the foot, and a pair of elastomeric bands for arm exercise.

U.S. Pat. No. 5,186,698, issued to Bradley R. Mason et al. on Feb. 16, 1993, describes four different ankle exercisers. The first is an elastomeric band stretched between a foot strap and a door strap. The second is an elastomeric band stretched between a foot strap and a handgrip. The third is a towel used for exercising the toes by pulling the towel towards or away from the user. The fourth is a rocking platform sitting on a pair of curved, parallel runners.

U.S. Pat. No. 5,368,536, issued to Mark E. Stodgell on Nov. 29, 1994, describes an ankle rehabilitation device. The device includes a foot platform mounted on a universal joint, which is in turn mounted on a base. Resistance to movement is provided by an articulated two bar linkage and a coil spring connected between one bar and the base. Adjusting the distance between the spring and the end of the bar changes the level of resistance. A similar foot support is taught by the U.S. Pat. No. 5,722,919 issued to Timmer, except without the use of an articulated spring linkage.

None of the above patents describes an ankle and hip exercising apparatus providing for the large number of exercises accommodated by the present invention, providing for bidirectional resistance, and providing feedback to the user. None of the above inventions and patents, taken either singly or in combination, is seen to describe the instant invention as claimed.

SUMMARY OF THE INVENTION

The invention is an ankle and hip exercising apparatus which provides for a wide variety of exercises for both rehabilitative and conditioning purposes. The apparatus includes a base board having at least one peg having a rounded top and which may include several anchoring points, several elastomeric resistance members such as surgical tubing, and an overshoe having a flange for attachment of the resistance members and a sole with divots for cooperating with the base board's pegs.

The overshoe has the general configuration of a sandal, and is preferably dimensioned and configured to fit over a standard athletic shoe. The overshoe includes a sole, preferably made from ½ inch thick plastic. The bottom of the sole has three concave, hemisphere-shaped divots, with one located within the heel portion, one directly underneath the ball of the foot, and one located in the center. The top of the sole includes a heel support, and a pair of instep straps using hook and loop fasteners such as those marketed under the trademark, VELCRO. The edge of the heel and toe portions include flanges having a plurality of holes.

The base board includes at least one peg having a rounded top, for cooperating with the divots in the overshoe's sole, and may also include a plurality of attachment members such as eyelets. The board preferably includes angle measurement indicia, thereby providing the user and therapist or trainer with feedback about the user's progress.

Resistance is provided by elastomeric resistance members such as surgical tubing. In the invention's first embodiment, wherein the board includes a plurality of eyelets, the surgical tubing will include a hook at either end, with one hook passing through a hole within the flange on the overshoe's heel or toe portion, and the other hook passing through one of the board's eyelets. The second embodiment has surgical tubing having a hook at one end for the overshoe's flanges, and an O-ring and hook and loop fastener strap at the other end. The hook and loop fastener strap is wrapped around the leg of a piece of furniture, passed through the O-ring, and then passed back around the furniture to overlap itself, allowing the corresponding hooks and loops to connect with each other.

In the invention's third embodiment, the base board is eliminated. Instead, the surgical tubing attaches to a piece of furniture, or to a handle.

The ankle and hip exercising apparatus provides for a wide range of possible exercises. For example, by attaching surgical tubing to the toe flange and using the heel divot to connect with one of the pegs, the user may exercise the tibialis anterior, peroneus tertius, and extensor digitorum longus by rotating the foot upward (dorsi flexion). The user may develop proprioception (awareness and control of balance and motion) by attaching a second surgical tubing to one side of the overshoe, and attempting to rotate the foot upwards without moving it to either side. Alternatively, the user may attempt to develop range of motion by rotating the foot to either side. The angle degree indicia will show the user his progress.

Alternatively, the user may attach surgical tubing to the outside of his foot, and attempt to rotate his foot so that the outer edge moves upward (eversion). This will exercise the peroneus tertius, extensor digitorum longus, peroneus brevis, and peroneus longus. By attaching the surgical tubing to the inside of the foot and attempting to rotate the inside edge upward (inversion), the user can exercise the tibialis posterior.

Additional ankle exercises may be performed by placing the overshoe's toe divot on the peg, and attaching surgical tubing to the heel flange. By rotating heel upward (corresponding to plantar flexion, or rotating the toes downward), the user can exercise the tibialis posterior, peroneus brevis, peroneus longus, gastrocnemius, and soleus. All of the above ankle exercises may be performed while sitting or standing. Although use of the base board is preferred and suggested for performing dorsi and plantar flexion exercises, they may be performed without the base board if necessary.

By placing the overshoe's center divot on the peg, and attaching surgical tubing to both the toe and heel flanges, the user may perform hip rotation exercises. Rotating the hip outward (lateral rotation) exercises the sartorius, pectineus, piriformis, gluteus maximus, and psoas major. Likewise, rotating the hip inward (medial rotation) exercises the gluteus medius. Both hip rotations must be performed while standing.

In performing all of the above exercises, the mating divot in the overshoe and peg on the board prevent the user's foot from sliding towards the anchoring point of the surgical tubing while exercising, thereby ensuring that the user is actually working against the surgical tubing and not merely sliding his foot to allow it to rotate. The amount of resistance provided may be varied by using different strength surgical tubing, using multiple surgical tubing, or by changing the attachment point of the surgical tubing to the overshoe. Attaching the surgical tubing to the overshoe's flange relatively far away from the peg increases the length of the resistance arm (distance from the fulcrum to the resistance) formed by the lever comprising the peg and divot connection (fulcrum), resistance (surgical tubing), and effort (muscles), thereby increasing the amount of force required to stretch the surgical tubing.

Additional hip exercises may be performed without the use of the base board, by connecting the surgical tubing between the rear of the shoe and a piece of furniture. Elevating the leg forward (hip flexion) while using this apparatus exercises the iliopsoas. Likewise, connecting the surgical tubing between the front of the shoe and a piece of furniture allows exercising the gluteus maximus through hip extension (rear leg elevation) exercises. A unique combination disc and hemispherical ball support is used as a threaded attachement to the shoe in modified form to distribute weight which produces stress about the ankle in various areas of the foot.

Accordingly, it is a principal object of the invention to provide an ankle exercising device for strengthening the muscles used for dorsi flexion.

It is another object of the invention to provide an ankle exercising device for strengthening the muscles used for plantar flexion.

It is a further object of the invention to provide an ankle exercising device for strengthening the muscles used for inversion.

Still another object of the invention is to provide an ankle exercising device for strengthening the muscles used for eversion.

A fifth object of the invention is to provide an ankle exercising device for increasing the ankle's rotational range of motion.

A sixth object of the invention is to provide a hip exercising device for exercising the muscles used for hip rotation.

A seventh object of the invention is to provide an ankle and hip exercising device which prevents cheating by the user by securing the pivot point in place relative to the surgical tubing's anchoring point.

An eighth object of the invention is to provide an ankle and hip exercising device which develops proprioception through bidirectional resistance.

A ninth object of the invention is to provide an ankle and hip exercising device providing for varying the amount of resistance supplied.

A final object of the invention is to provide an ankle and hip exercising device which minimize ankle rotations by spreading concentrated forces of weight about the ankle over a selective rolling surface area via a combination disc and half hemispherical shoe support.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is an ankle and hip exercising apparatus. Referring to the Figures, the exercise apparatus 10 includes a base 12, an overshoe 14, and at least one elastomeric resistance member 16.

Figure 7:
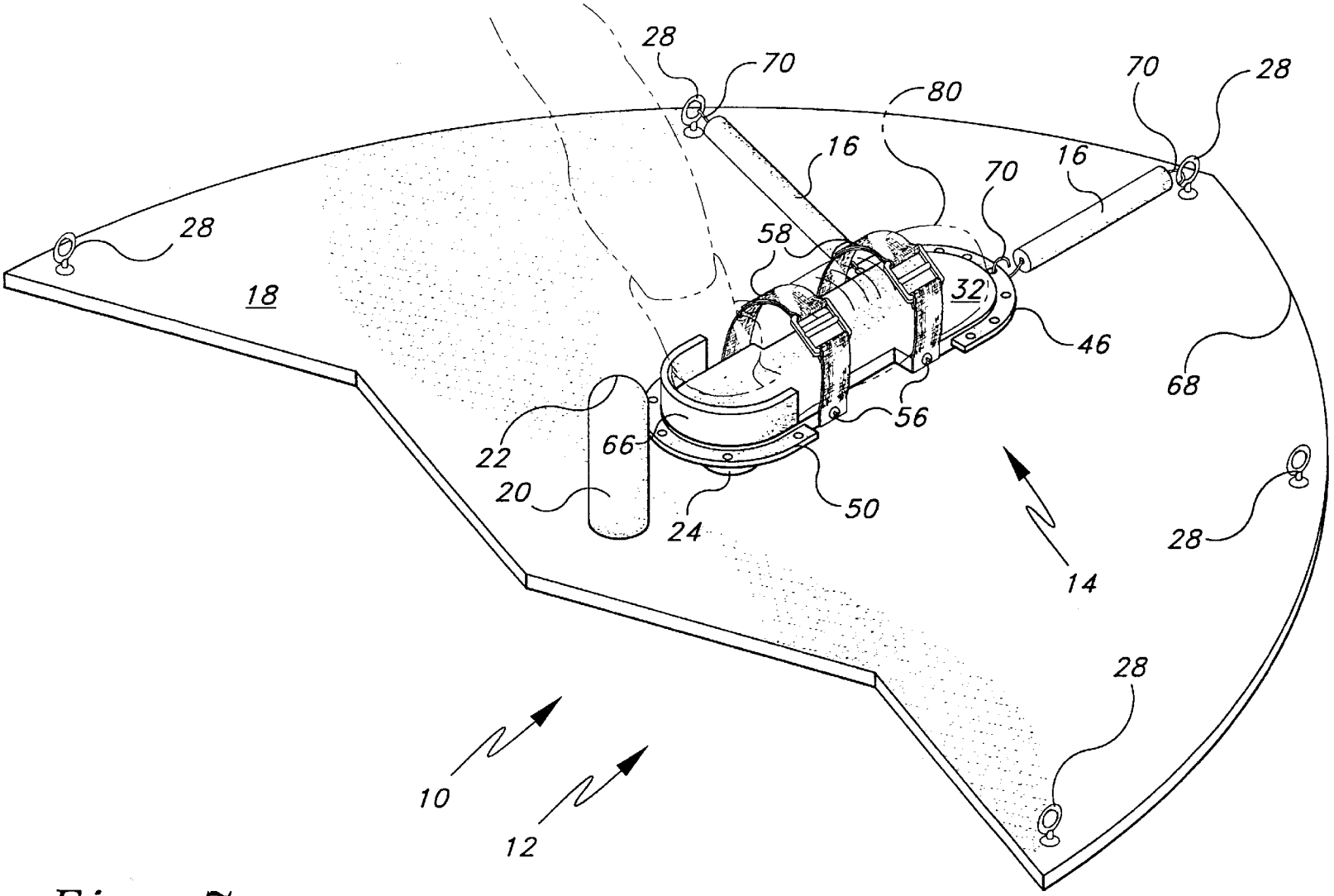
FIG. 7 is an environmental, perspective view of a first embodiment of an ankle and hip strengthening apparatus according to the present invention, showing a standing user performing dorsi flexion exercises with bidirectional resistance.
Figure 8:
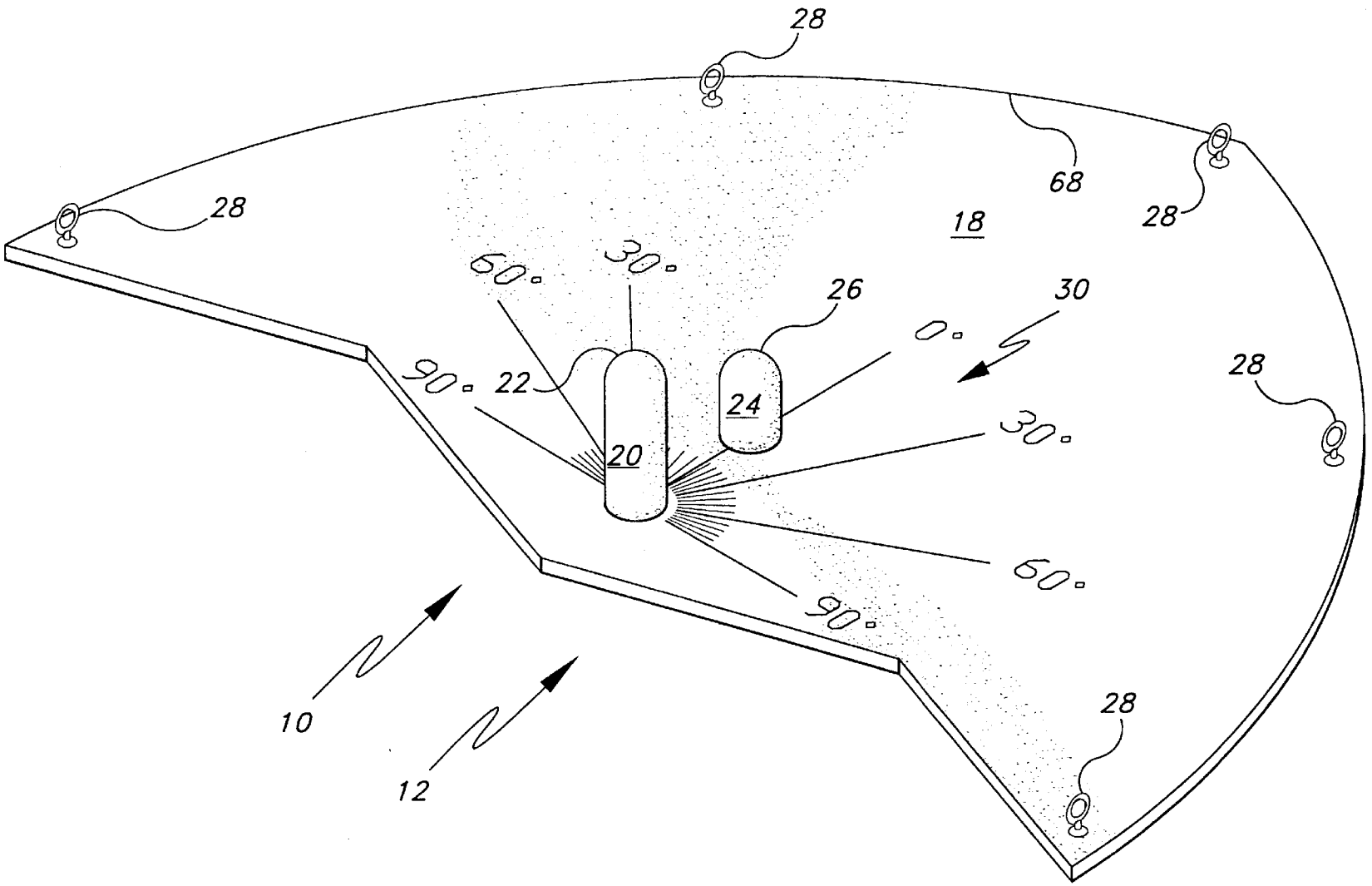
FIG. 8 is a top perspective view of a base board for a first embodiment of an ankle and hip strengthening apparatus according to the present invention.

The first embodiment of the base 12 is best illustrated in FIG. 7. The base 12 includes board 18, preferably made from plastic. The board 18 preferably has the approximate shape of a semicircle, with curved portion 68 defining the front and sides. Suggested dimensions for board 18 are 42 inches long side to side, 28 inches wide front to back, and ½ inch thick, although other dimensions could easily be used without deviating from the basic function of the invention. A first peg 20 protrudes upward adjacent to the rear portion of board 18. Peg 20 includes a hemispherical top surface 22. Peg 20 is preferably about 4 inches in height, but other dimensions could easily be used. A second, shorter peg 24 is located in front of peg 20, and also includes a hemispherical top surface 26. A plurality of eyelets 28 are located around the front and side edges of board 18, with at least one eyelet 28 located centrally in the front portion of board 18, and additional eyelets 28 located along each side of board 18. Eyelets 28 are preferably of the threaded type for screw-in attachment to the board 18. The board 18 preferably also includes angle measurement indicia 30 around peg 20.

Figure 12:
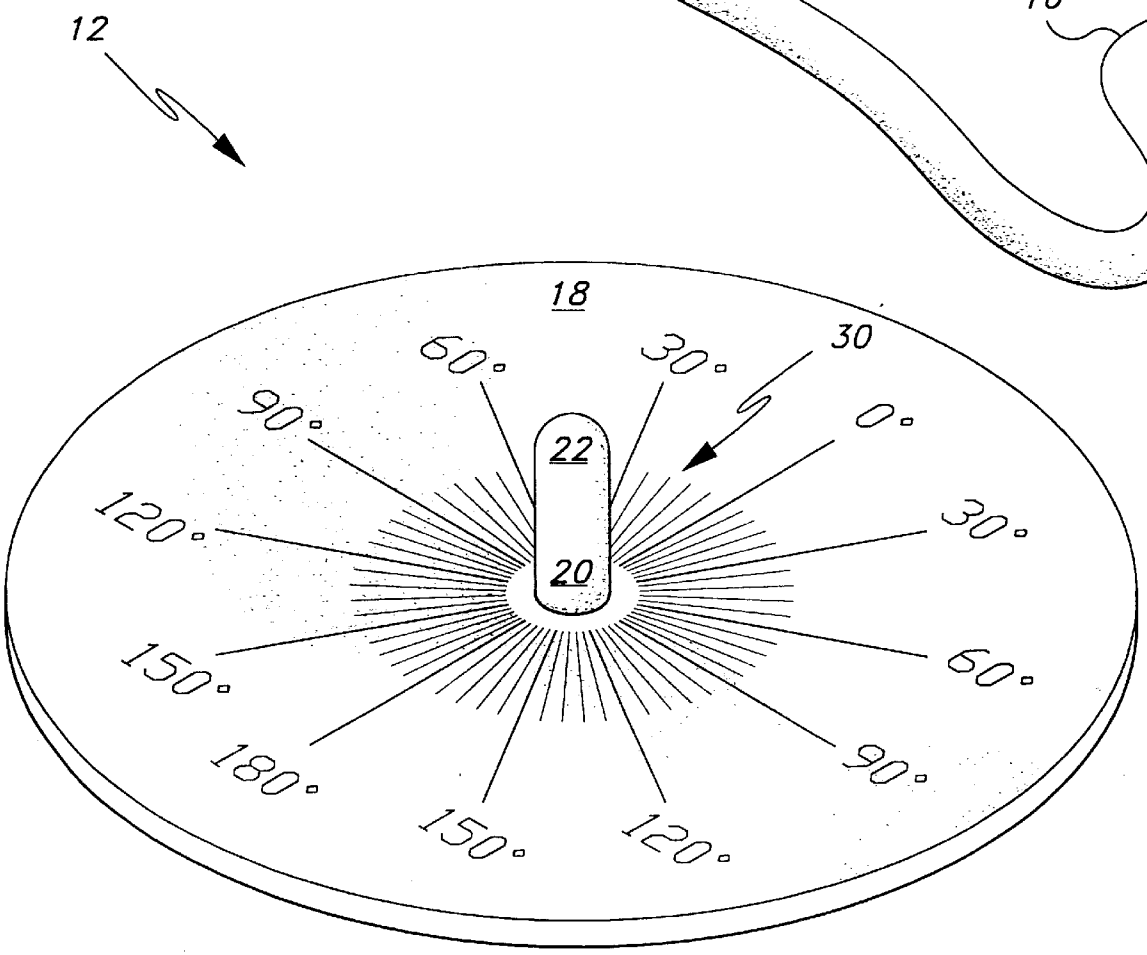
FIG. 12 is a top perspective view of a base board for a second embodiment of an ankle and hip strengthening apparatus according to the present invention.

An alternative base 12 is illustrated in FIG. 12. Base 12 includes board 18, preferably made from plastic. Suggested dimensions for the alternative board 18 are 10 inches in diameter by ½ inch thick, although other dimensions could obviously be used. Peg 20 is located centrally on board 18, and is identical to peg 20 of FIG. 7, including hemispherical top 22. The board 18 also includes angle measurement indicia 30.

Figure 9:
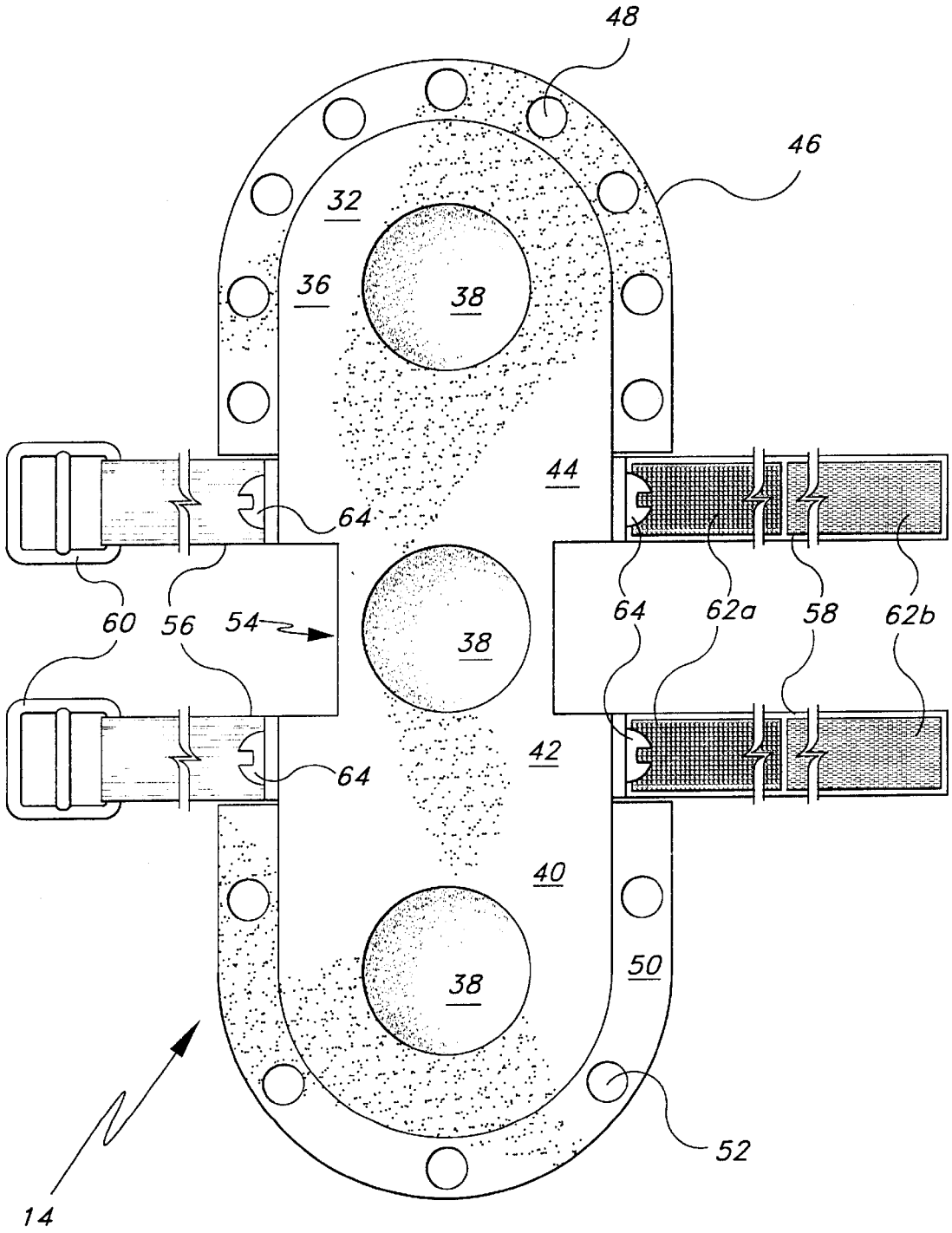
FIG. 9 is a bottom view of an overshoe for according to a first embodiment of an ankle and hip strengthening apparatus according to the present invention.
Figure 10:
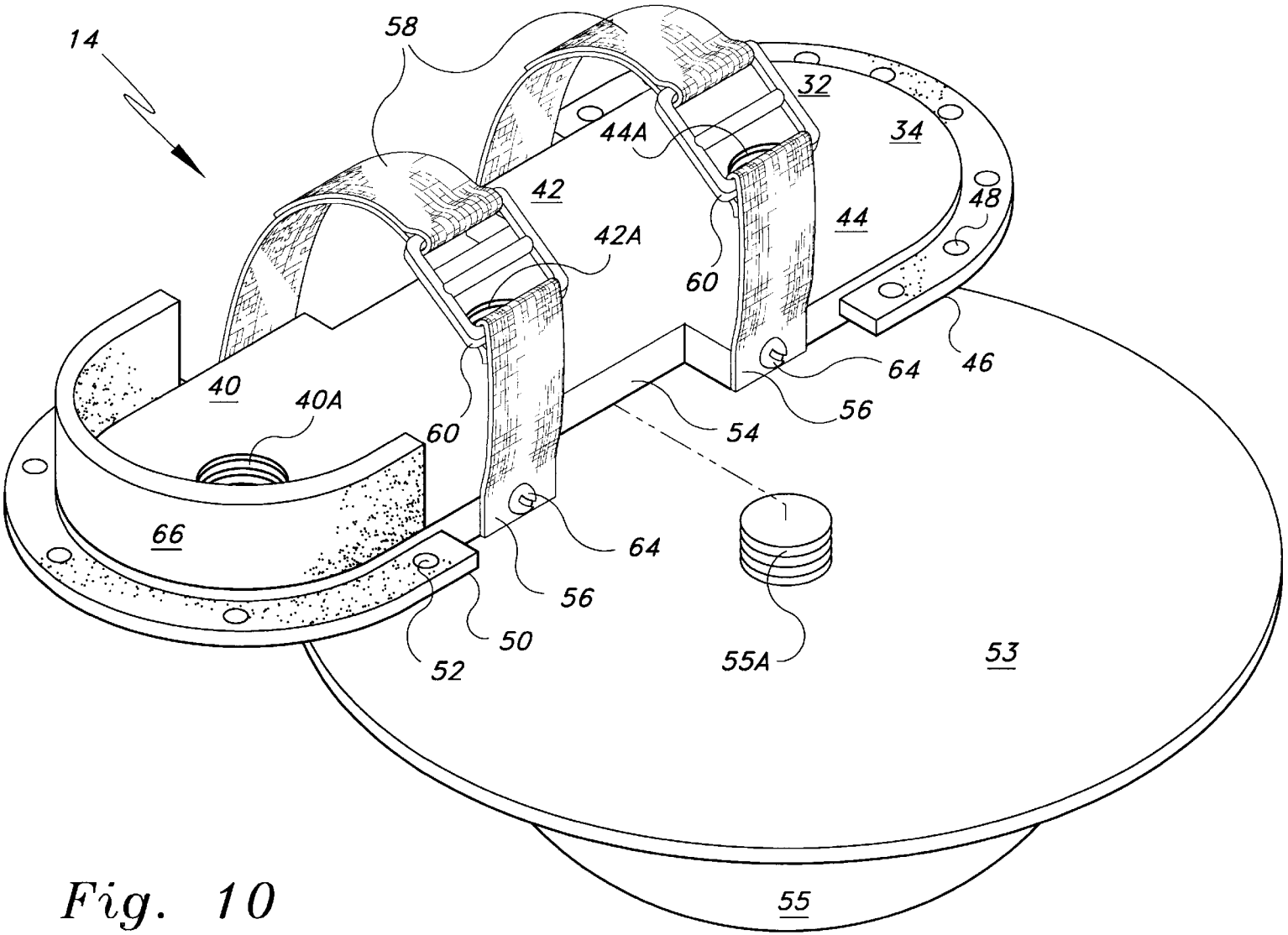
FIG. 10 is a top and side perspective view of an overshoe according to a second embodiment of an ankle and hip strengthening apparatus according to the present invention.

FIGS. 9 and 10 illustrate the overshoe 14 according to both respective embodiments used with the bases 12 in one application and with the combination disc and half spherical ball attachment support as further discussed below. According to the first embodiment, the overshoe 14 includes a sole 32, having a top surface 34 and a bottom surface 36. The sole 32 is preferably made from ½ inch thick plastic, although other materials and dimensions will work with the present invention.

The bottom surface 36 includes three concave hemispherical divots 38, with one divot 38 located in the heel portion 40, a second located in the center portion 42, and a third located in the toe portion 44. Divots 38 are dimensioned and configured to cooperate with the hemispherical tops 22,26 of pegs 20,24. As diagrammatically illustrated in FIG. 10, a second embodiment of the shoe 14 is shown modified with a series of linearly disposed threaded apertures 40A, 42A and 44A in place of the divots 38 for attaching thereto a combination disc 53 and hemispherical ball 55 support via threaded stem 55A. The stem 55A is anchored to the ball 55 and threadedly secured to the disc 53 as single integrated shoe 14 support. The diameter of the disc ranges from 8 to 12 inches to uniformly distributed weight from a user across a broader surface area to reduce or minimize moments about the ankle (or at a single concentrated point) during extended exercise.

The outside edge 54 of toe portion 44 includes a flange 46 having a plurality of holes 48, with nine holes being a suggested number. Similarly, the outside edge 52 of heel portion 40 includes flange 50 having a plurality of holes 52, with five holes being a suggested number. The flanges 46,50, are preferably made from the same piece of plastic as sole 32. The outside edge 54 also includes straps 56,58 for fastening the overshoe to the user's shoe. Straps 56 include buckle 60. Straps 58 include mating hook and loop fastener portions 62*a*,62*b*. Straps 56,58 preferably attach to outside edge 54 using screws 64.

Top surface 34 includes heel support 66, extending around the heel portion 40. When using the invention, a user, preferably wearing athletic shoes, will place the heel of the athletic shoe 80 (FIGS. 1–7) against the heel support 66, and the bottom of the shoe along the top surface 34. The user will then insert straps 58 through buckles 60, attaching hook fastening component 62*b* to loop fastening component 62*a*, thereby securing the overshoe to his foot.

Figure 11A:
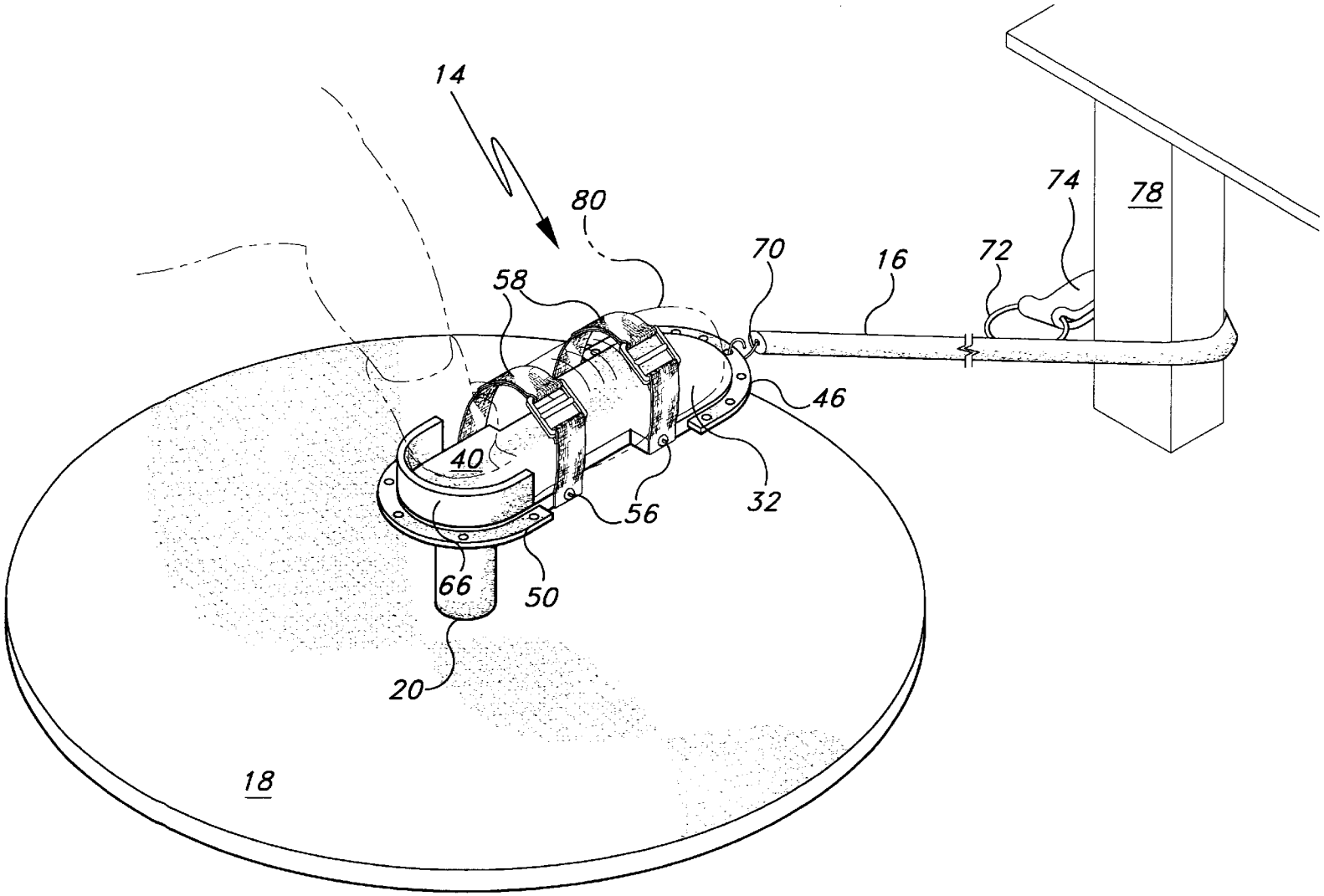
FIG. 11A is an environmental, perspective view of a first embodiment of an ankle and hip strengthening apparatus according to the present invention, showing a sitting user performing dorsi flexion exercises with unidirectional resistance.
Figure 11B:
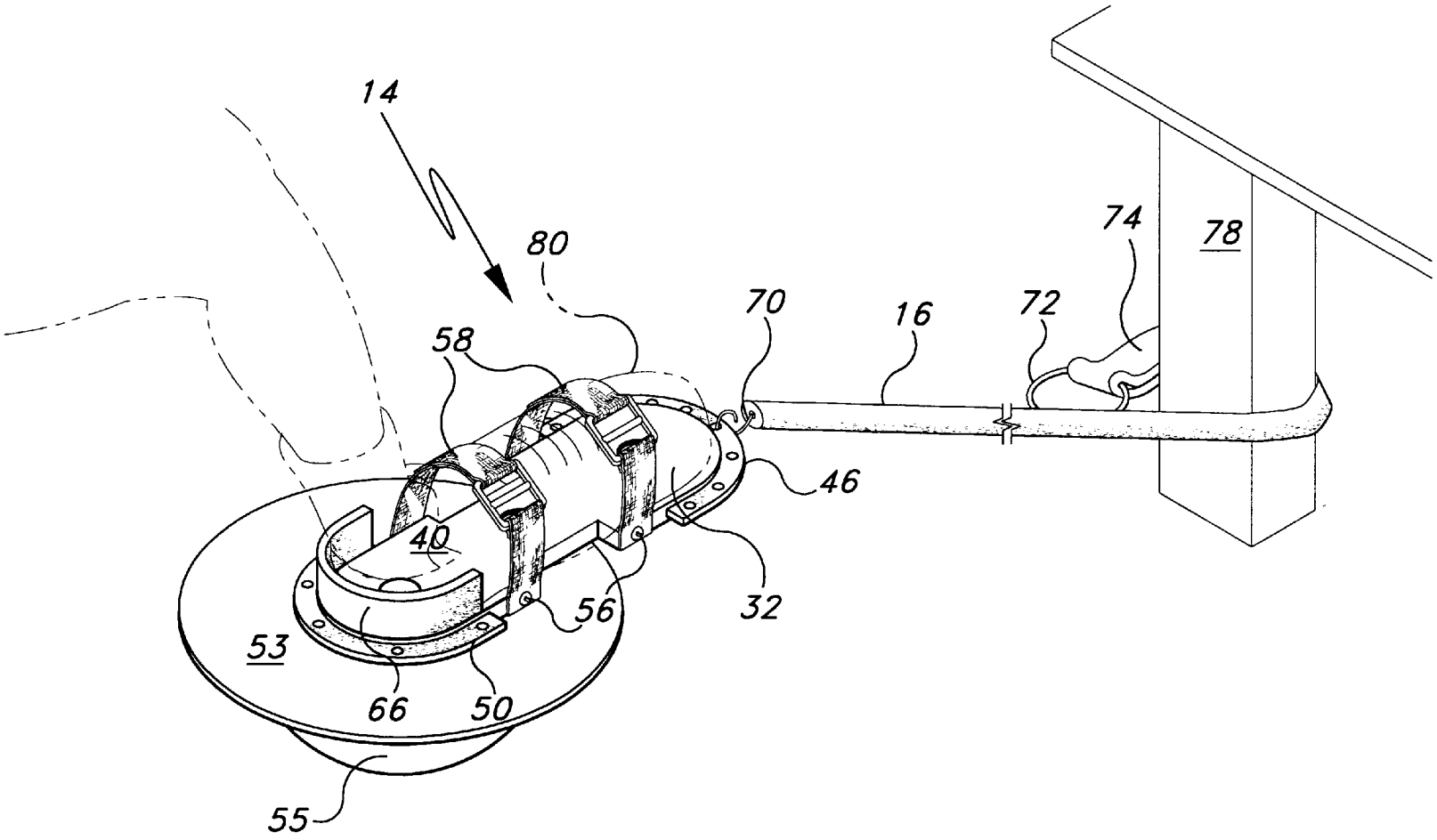
FIG. 11B is an environmental, perspective view of a second embodiment of an ankle and hip strengthening apparatus according to the present invention, showing a sitting user performing dorsi flexion exercises with unidirectional resistance, via a disc and ball mechanical support.
Figure 13:
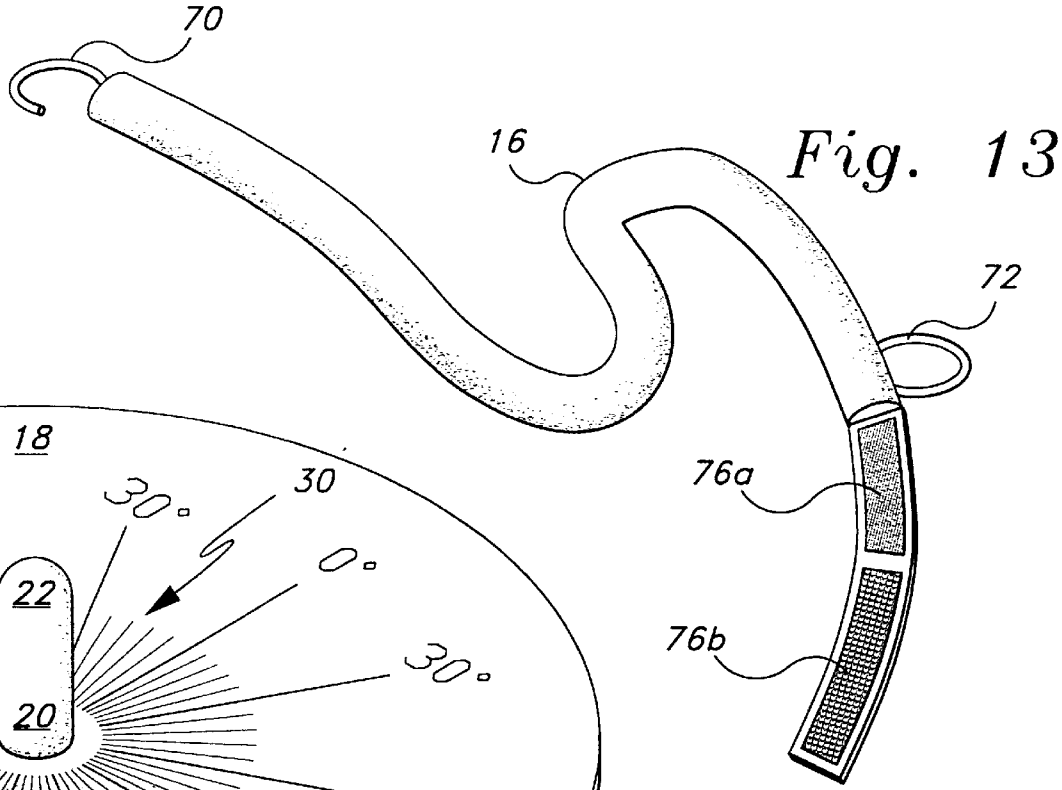
FIG. 13 is a perspective view of a surgical tubing resistance member for a second embodiment of an ankle and hip strengthening apparatus according to the present invention.
Figure 14:
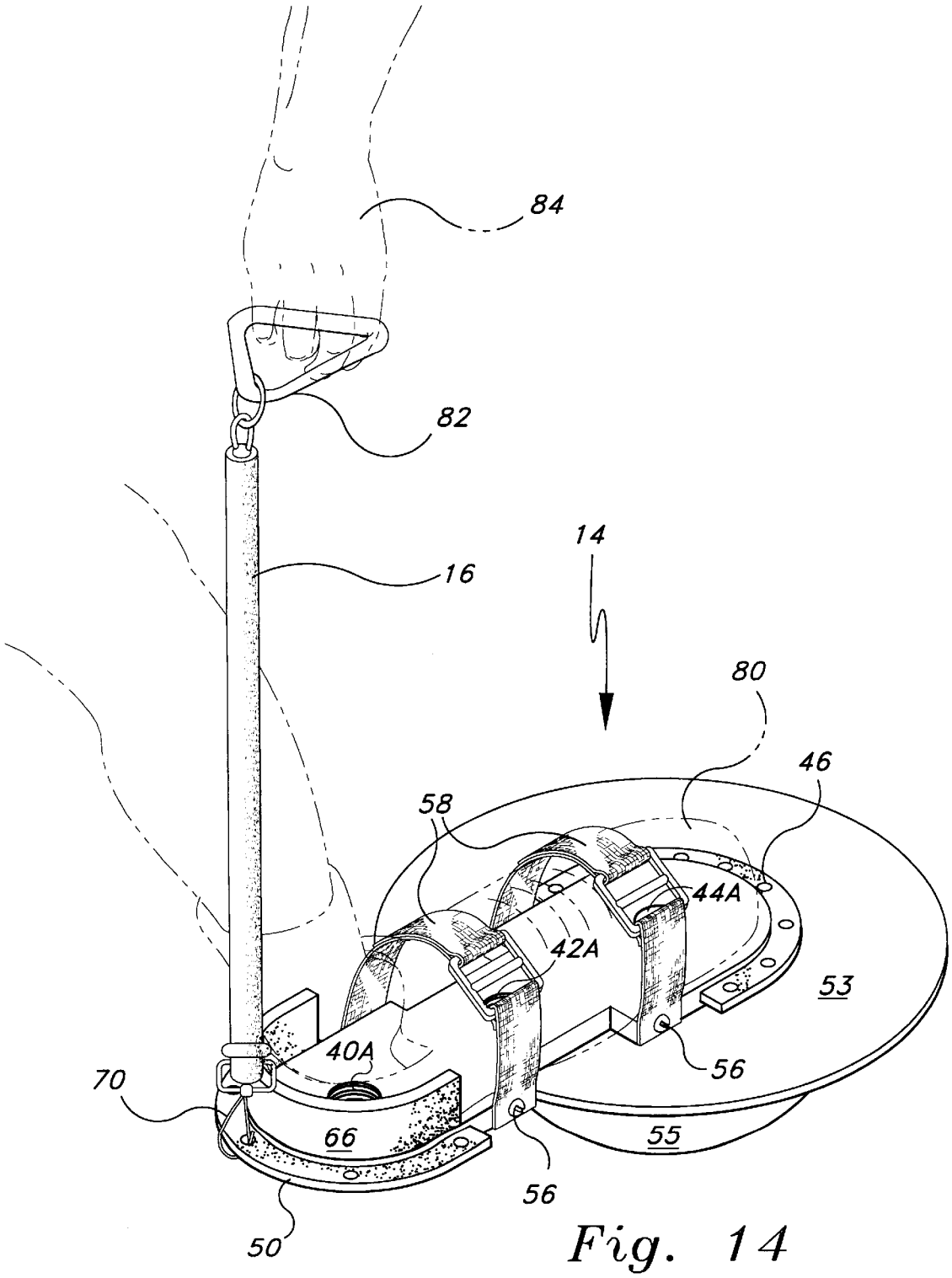
FIG. 14 is an environmental, perspective view of a third embodiment of an ankle and hip strengthening apparatus according to the present invention, showing dorsi flexion exercises being performed via the attachment of the disc and ball support at a front location of the shoe according to the second embodiment.

The elastomeric resistance member 16 is preferably a length of surgical tubing, although other flexible, elastomeric materials could be used successfully with the present invention. FIGS. 1–7 illustrate a first embodiment of surgical tubing 16. The surgical tubing must include means for securing each end of the tubing to either the shoe or to an anchoring point. The first embodiment includes a hook or clip 70 (a clip is illustrated in FIG. 14) at each end, with one hook or clip 70 fitting within holes 48,52 of flanges 46,50 of overshoe 14, and the other hook or clip 70 fitting within one of the eyelets 28 of base 12. A second embodiment of surgical tubing 16 is illustrated in FIGS. 11A, 11B and 13. One end of the second embodiment includes a hook 70 for connecting within holes 48,52. The other end includes a ring 72 and connecting strap 74, having mating hook and loop components 76*a*,76*b*.

In use, connecting strap 74 is wrapped around a piece of furniture, such as table leg 78, passes through ring 72, and overlaps itself so that hook fastening component 76*b* mates with loop fastening component 76*a*. Accordingly, FIGS. 11B, 14, 15 and 16 diagrammatically illustrates exemplary applications of the combination disc 53 and ball support 55 according to the second embodiment. As shown therein, each respective attachment position 40A, 42A and 44A of the combination disc 53 and ball support 55 to the shoe 14 according to the second embodiment produce tension in different areas of the foot for isolating and stimulating various muscles around the ankle.

Figure 17:
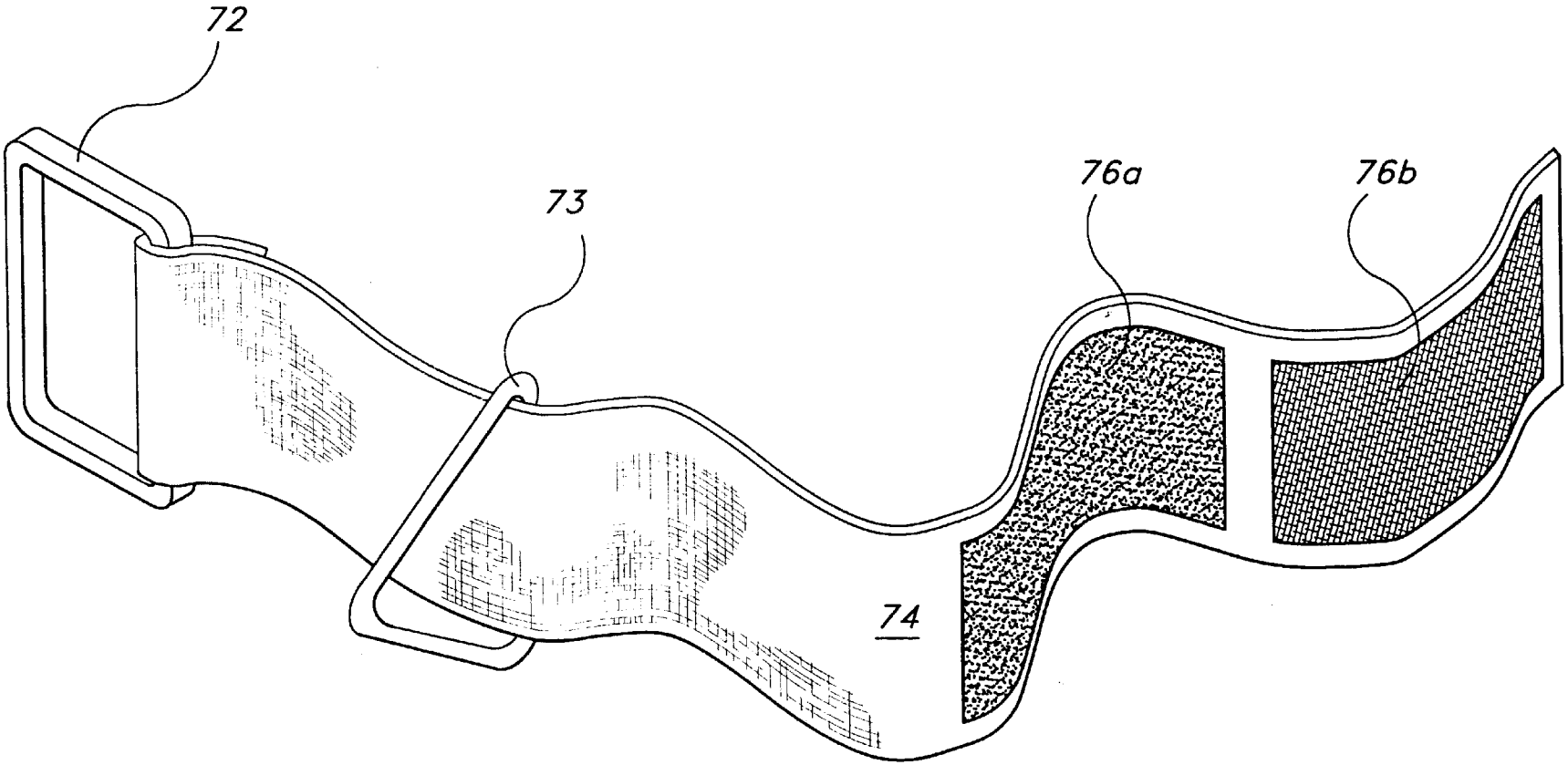
FIG. 17 is a perspective view of a strap for attaching surgical tubing resistance members to a piece of furniture.

Alternatively, the connecting strap 74, illustrated in FIG. 17, may be used in conjunction with the first embodiment of the surgical tubing 16. Connecting strap 74 is again wrapped around a piece of furniture so that mating hook and loop fasteners 76*a*,76*b* are secured together around ring 72, dimensioned and configured so that the hook or clip 70 of surgical tubing 16 may be secured to ring 73. The elastomeric resistance members 16 will preferably have several different strengths, allowing the user to choose the resistance member best suiting his level of conditioning.

Figure 1:
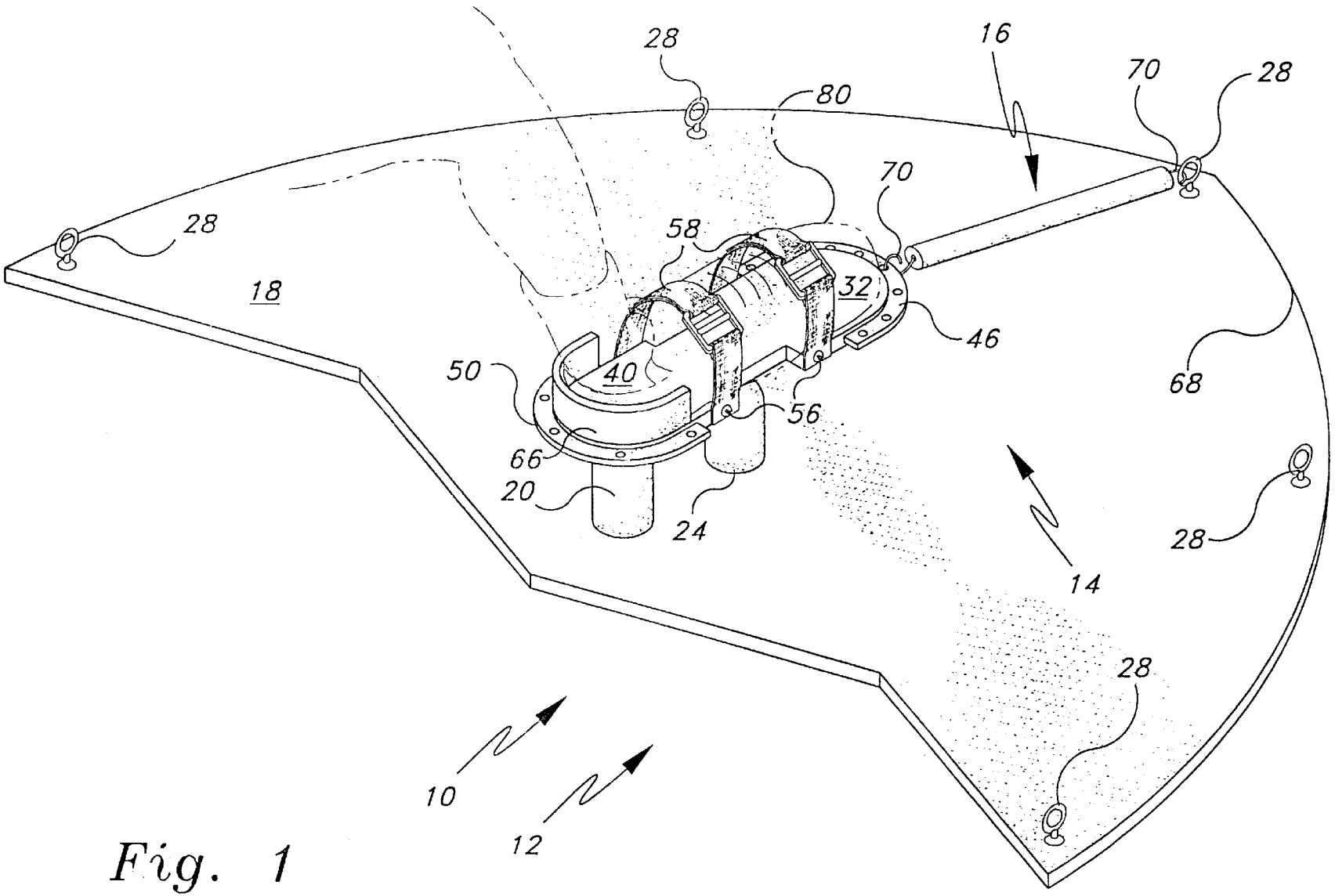
FIG. 1 is an environmental, perspective view of a first embodiment of an ankle and hip strengthening apparatus according to the present invention, showing a sitting user performing dorsi flexion exercises with unidirectional resistance.

The above described components may be interconnected to perform a wide variety of exercises for various rehabilitative or athletic conditioning purposes. Although most exercises are illustrated using the first embodiment only, all exercises may be performed using either embodiment. Referring to FIGS. 1, 11A and 11B of both embodiments, one of the most basic uses by a sitting user is illustrated. According to the first embodiment, divot 38 in the overshoe's heel portion 40 is placed on top of peg 20, and in the second embodiment the combination disc 53 and ball support 55 is disposed within the heel portion or a selective position (40A, 42A and 44A) via thread stem 55A. As in both embodiments hook 70 of surgical tubing 16 is connected to a hole 48 within front flange 46. The opposite end of surgical tubing 16 is connected either to eyelet 28 or table leg 78. Using this configuration of components, the user may perform either dorsal flexion or ankle rotation exercises. The cooperation between divot 38 and peg 20 prevents the user's foot from moving towards the eyelet 28 as the exercise is performed, thereby preventing cheating and ensuring that the user gets the full benefit of the exercise.

Figure 2:
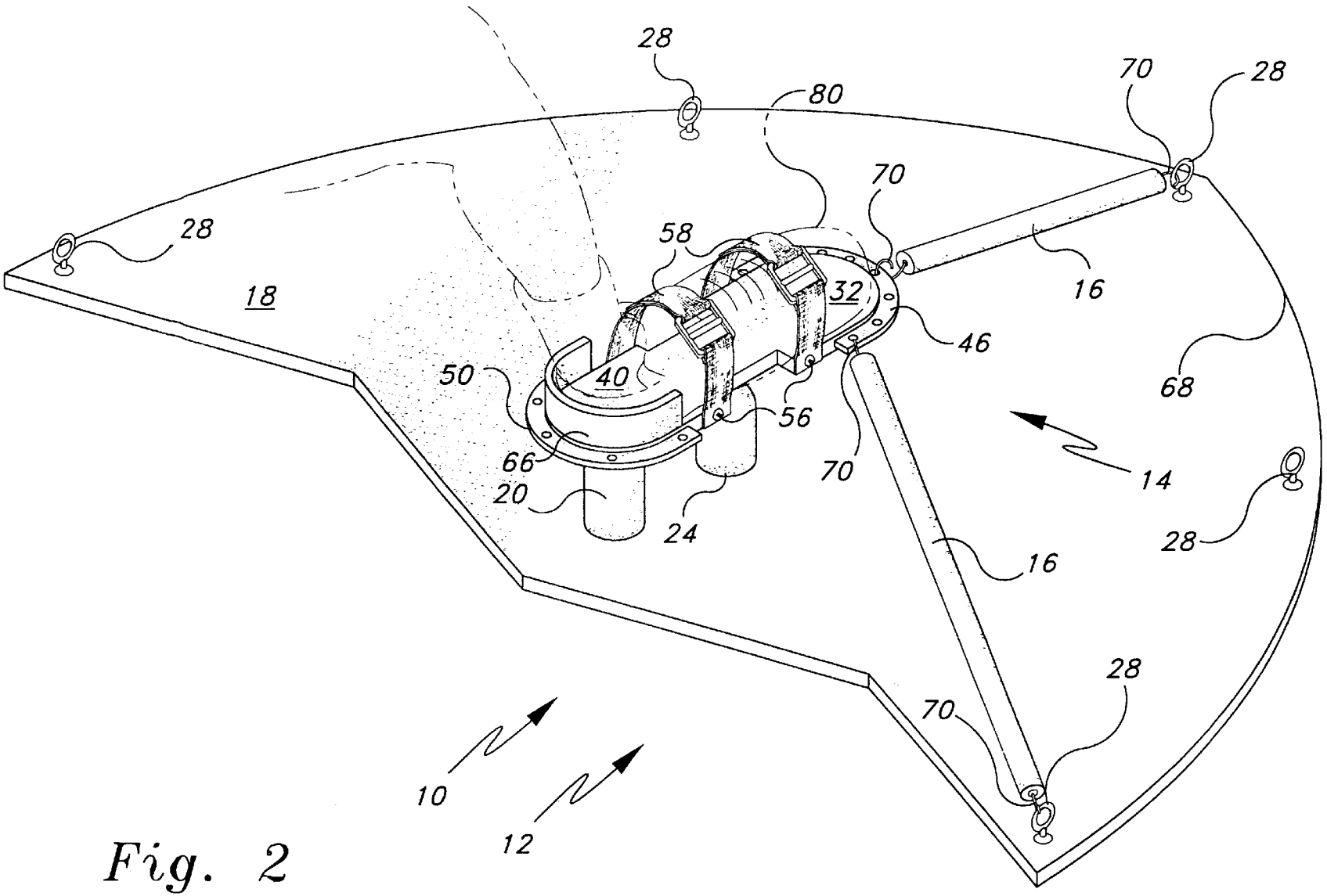
FIG. 2 is an environmental, perspective view of a first embodiment of an ankle and hip strengthening apparatus according to the present invention, showing a sitting user performing dorsi flexion exercises with bidirectional resistance.

Referring to FIG. 2, a slight variation of the configuration shown in FIG. 1 is illustrated. FIG. 2 demonstrates the addition of a second surgical tubing 16 to flange 46, extending to an eyelet 28 along the side of base 12. One surgical tube 16 thereby pulls forward on flange 46, while the second surgical tube 16 pulls flange 46 to one side. Using this configuration, the user attempts to perform dorsi flexion while avoiding any ankle rotation. Avoiding this ankle rotation involves both countering the force exerted by the second surgical tubing 16, and avoiding overcompensating for the force exerted by this second surgical tubing 16. The user thereby develops proprioception in addition to ankle strength. Alternatively, omitting the first surgical tubing 16 extending forward from flange 46 enables the user to perform inversion and eversion exercises, either of which is resisted by the second surgical tubing 16.

Figure 3:
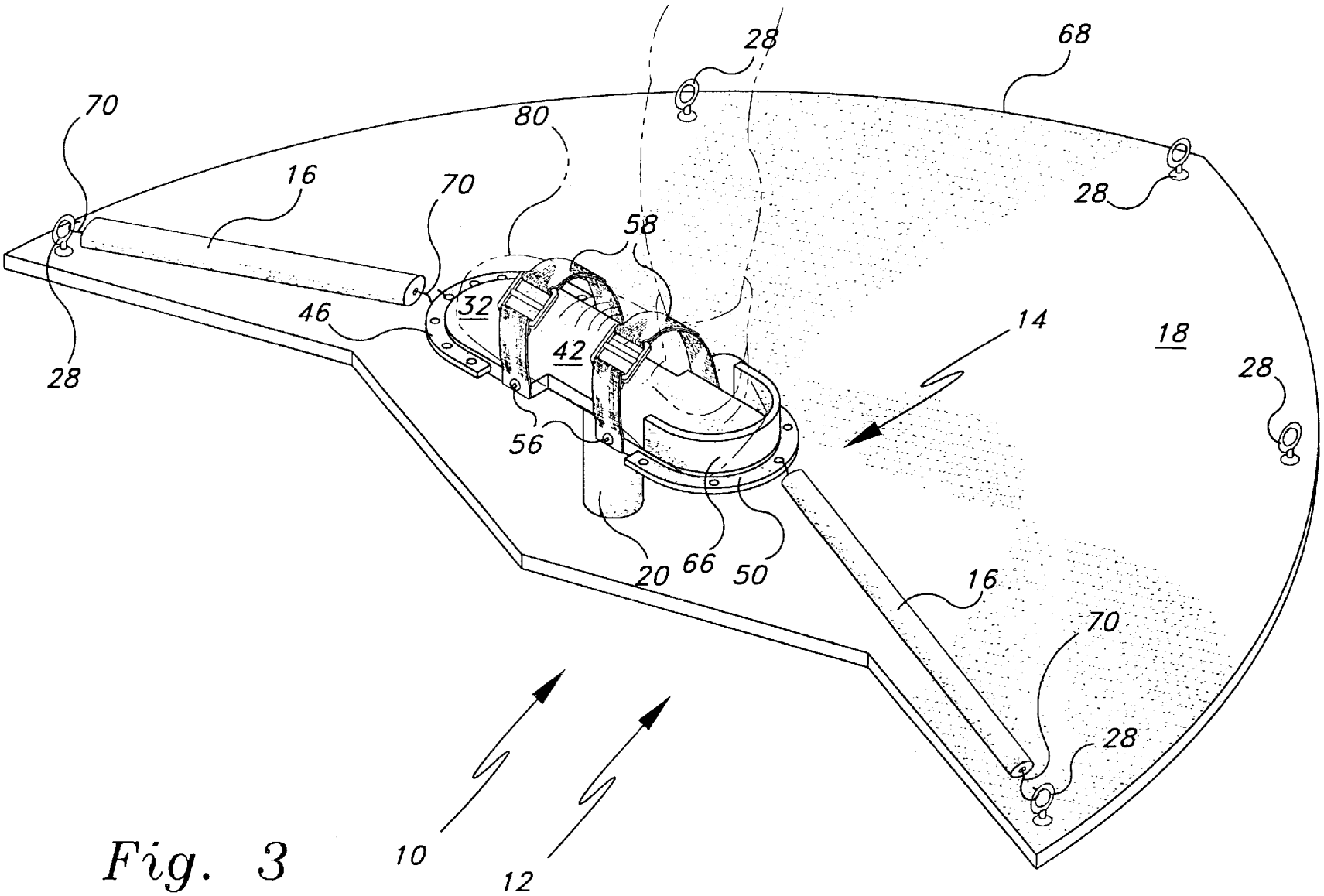
FIG. 3 is an environmental, perspective view of a first embodiment of an ankle and hip strengthening apparatus according to the present invention, showing a standing user performing hip rotation exercises while standing, with unidirectional resistance provided by two resistance members.

FIG. 3 illustrates a standing user performing hip rotation exercises. Divot 38 in the center 42 of overshoe 14 is placed on peg 20. A first surgical tube 16 is extended between flange 46 of the overshoe 12 and one eyelet 28, connected at each end by a hook 70. A second surgical tube 16 is extended from flange 50 of overshoe 14 to another eyelet 28 on the opposite side of base 12 from the first eyelet 28. The user may then perform lateral and/or medial hip rotation exercises, with both surgical tubing 16 providing resistance.

Figure 4:
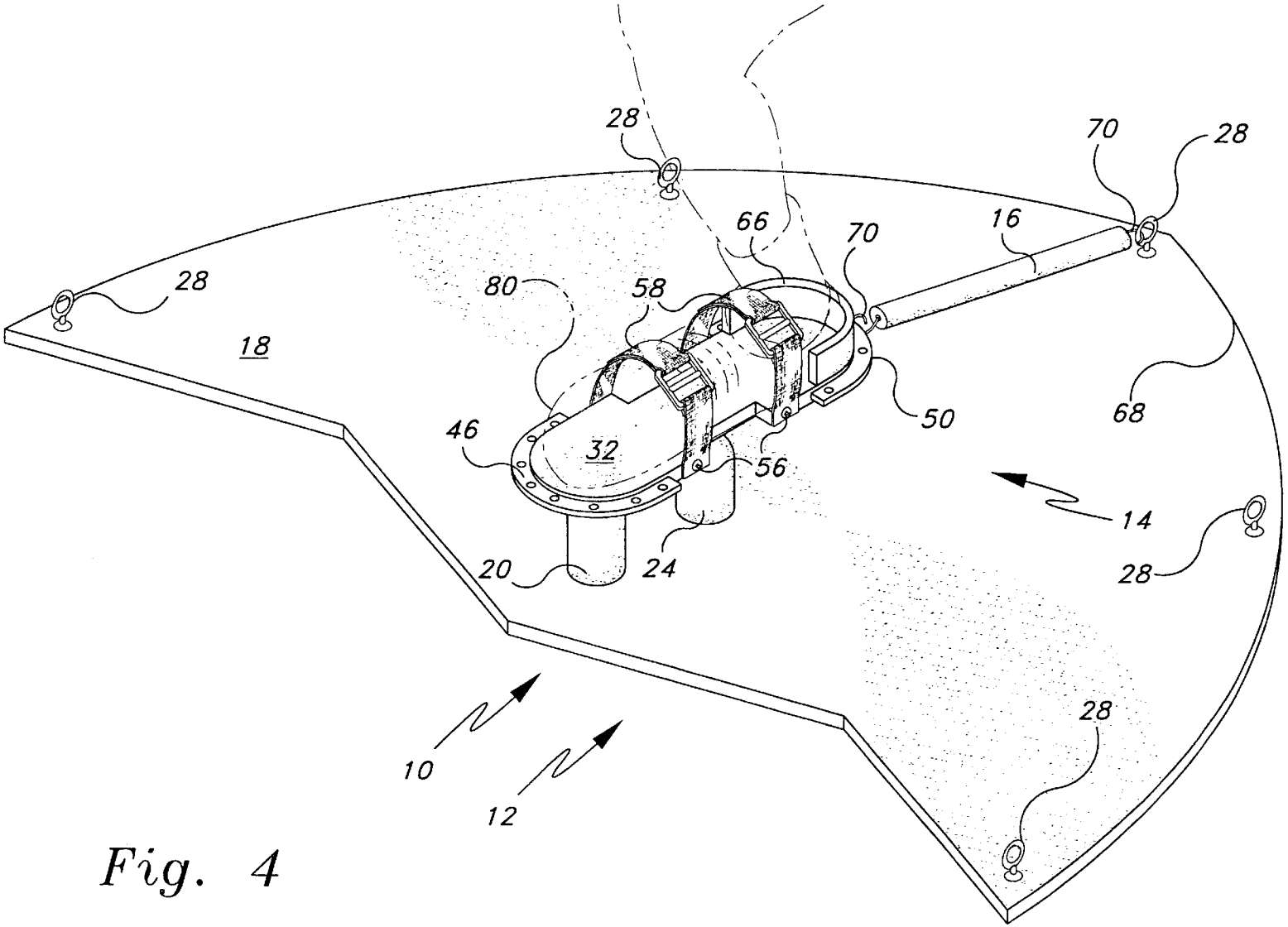
FIG. 4 is an environmental, perspective view of a first embodiment of an ankle and hip strengthening apparatus according to the present invention, showing a sitting user performing plantar flexion exercises with unidirectional resistance.

FIG. 4 illustrates a seated user performing plantar flexion exercises. Divot 38 in the front portion 44 of overshoe 12 is placed on top of peg 20. Surgical tubing 16 extends from the heel flange 50 of overshoe 14 to an eyelet 28, connecting at each end by hooks 70. The user may thereby perform plantar flexion exercises, resisted by the surgical tubing 16. The cooperation between divot 38 and peg 20 will prevent the user's foot from sliding towards the eyelet 28, preventing cheating and ensuring that proper exercise is performed.

Figure 5:
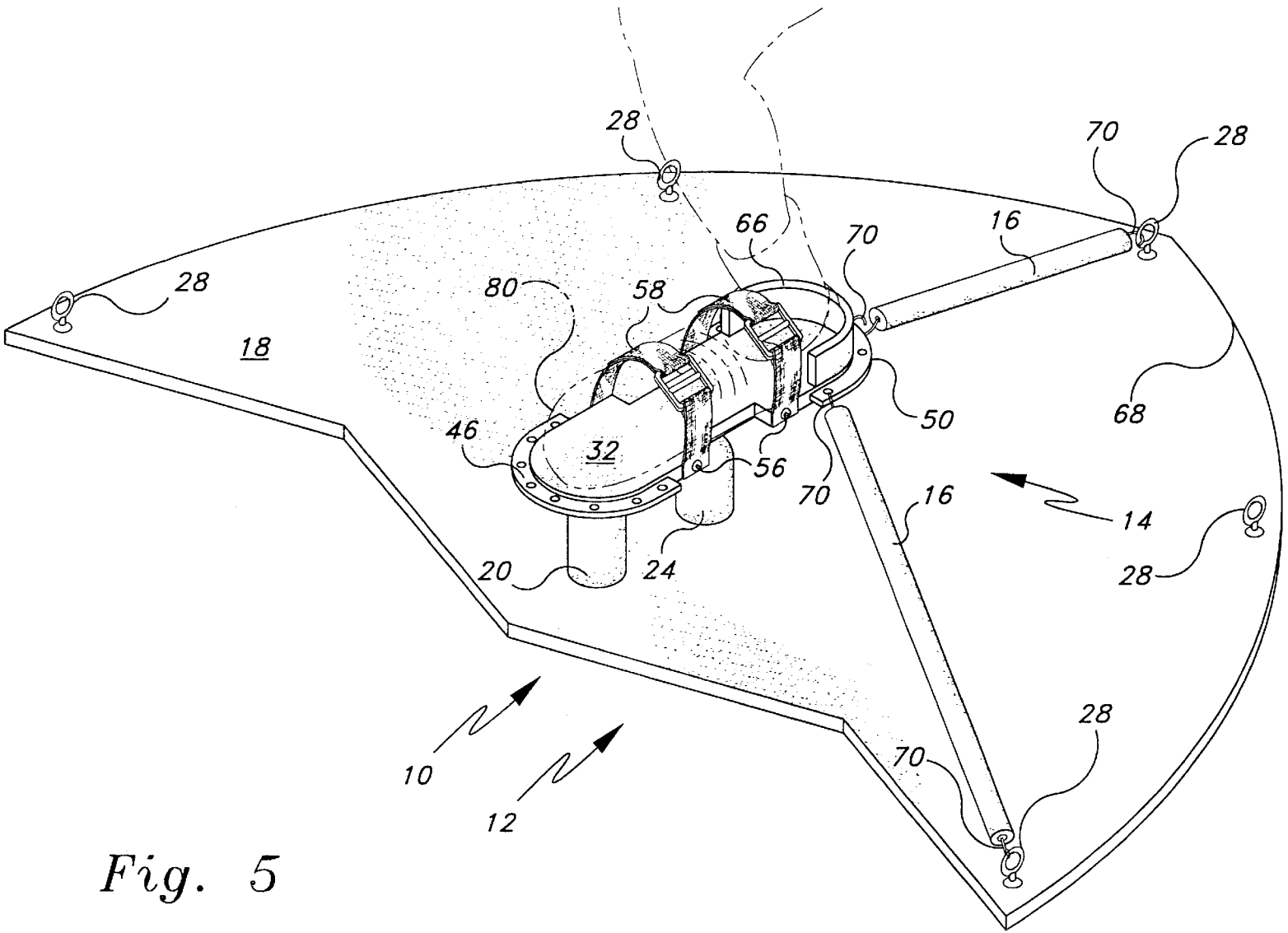
FIG. 5 is an environmental, perspective view of a first embodiment of an ankle and hip strengthening apparatus according to the present invention, showing a sitting user performing plantar flexion exercises with bidirectional resistance.

FIG. 5 illustrates one change to the configuration in FIG. 4. FIG. 5 shows the addition of a second surgical tubing 16 to flange 50, extending to an eyelet 28 on one side of the user's foot. The user performs plantar flexion exercises while attempting to avoid any side to side rotational movement of the foot. The user must therefore resist the force applied by the second surgical tubing 16, while also avoiding overcompensating for this force, while performing the exercise. The user therefore develops proprioception in addition to ankle strength.

Figure 6:
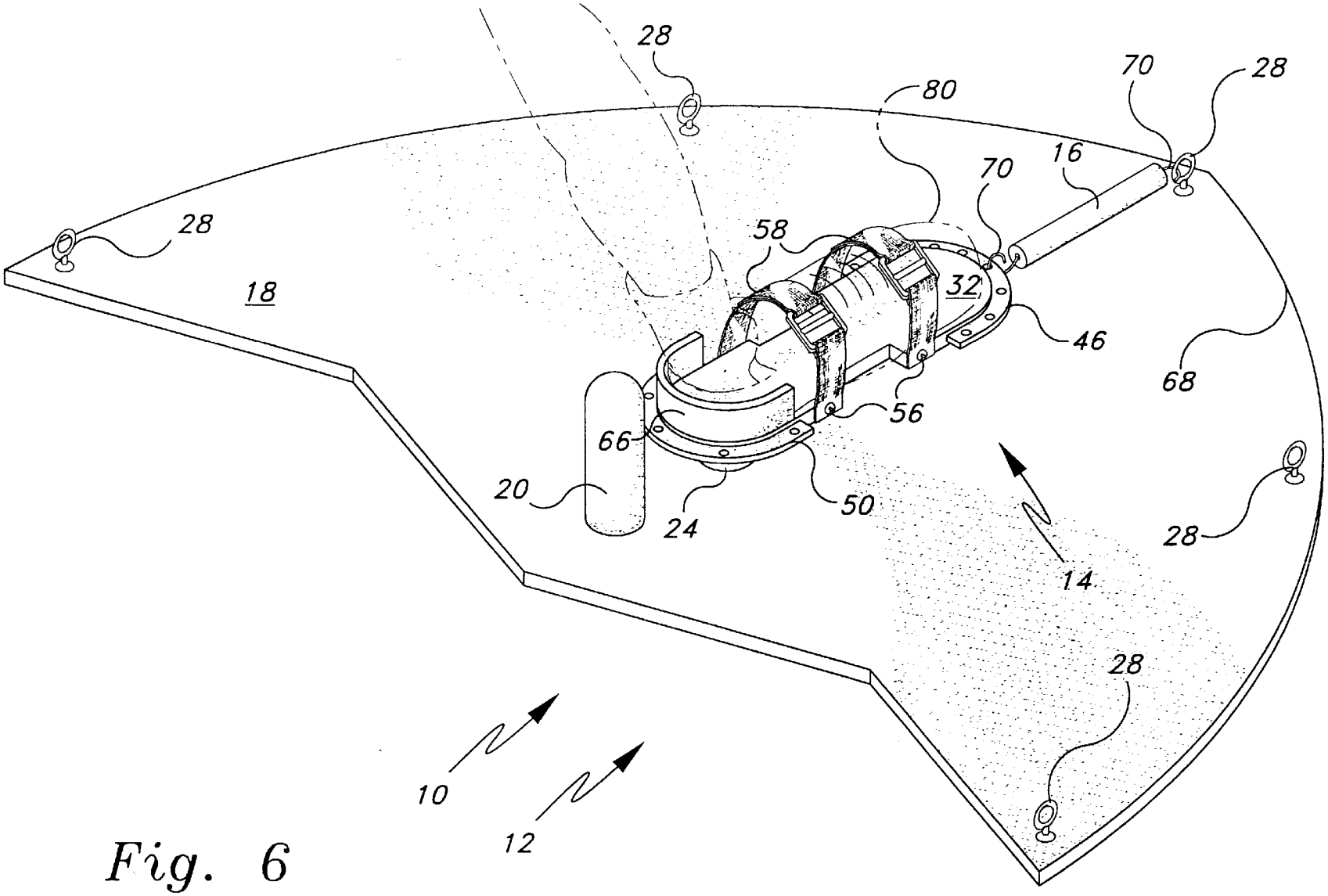
FIG. 6 is an environmental, perspective view of a first embodiment of an ankle and hip strengthening apparatus according to the present invention, showing a standing user performing dorsi flexion exercises with unidirectional resistance.

FIG. 6 illustrates a standing user performing the same dorsi flexion exercise as the sitting user illustrated in FIGS. 1, 11A and 11B recited above. To perform the exercise of FIG. 6 for example, divot 38 in the overshoe's heel portion 40 is placed on top of peg 24. Hook 70 of surgical tubing 16 is connected to a hole 48 within front flange 46. The opposite end of surgical tubing 16 is connected either to eyelet 28 or table leg 78. Using this configuration of components, the user may perform either dorsal flexion or ankle rotation exercises. The cooperation between divot 38 and peg 24 prevents the user's foot from moving towards the eyelet 28 as the exercise is performed, thereby preventing cheating and ensuring that the user gets the full benefit of the exercise.

Referring to FIG. 7, a slight variation of the configuration shown in FIG. 6 is illustrated. FIG. 7 demonstrates the addition of a second surgical tubing 16 to flange 46, extending to an eyelet 28 along the side of base 12. One surgical tube 16 thereby pulls forward on flange 46, while the second surgical tube 16 pulls flange 46 to one side. Using this configuration, the user attempts to perform dorsi flexion while avoiding any ankle rotation. Avoiding this ankle rotation involves both countering the force exerted by the second surgical tubing 16, and avoiding overcompensating for the force exerted by this second surgical tubing 16. The user thereby develops proprioception in addition to ankle strength. Alternatively, omitting the first surgical tubing 16 extending forward from flange 46 enables the user to perform inversion and eversion exercises, either of which is resisted by the second surgical tubing 16.

FIGS. 14–16 and 18–22 illustrate various exercises which may be performed using the shoe 14, with surgical tubing 16 secured to the front 46 or rear 50 flange of the shoe 14, without the base 12. For such use, the surgical tubing 16 may be secured to a piece of furniture as described above, or may be secured to a handle 82, which will be held in the hand 84 of user 86 while performing the exercises. Although some of the exercises performed will be similar to those described above, the type and direction of the resistance will change, providing a varied set of benefits.

FIG. 14 illustrates the shoe 14 and surgical tubing 16 secured to handle 82 being used to perform dorsi flexion exercises. Surgical tubing 16 is clipped to the rear flange 50 of shoe 14, so that flexing foot 80 upward stretches surgical tubing 16 between flange 50 and handle 82.

Figure 15:
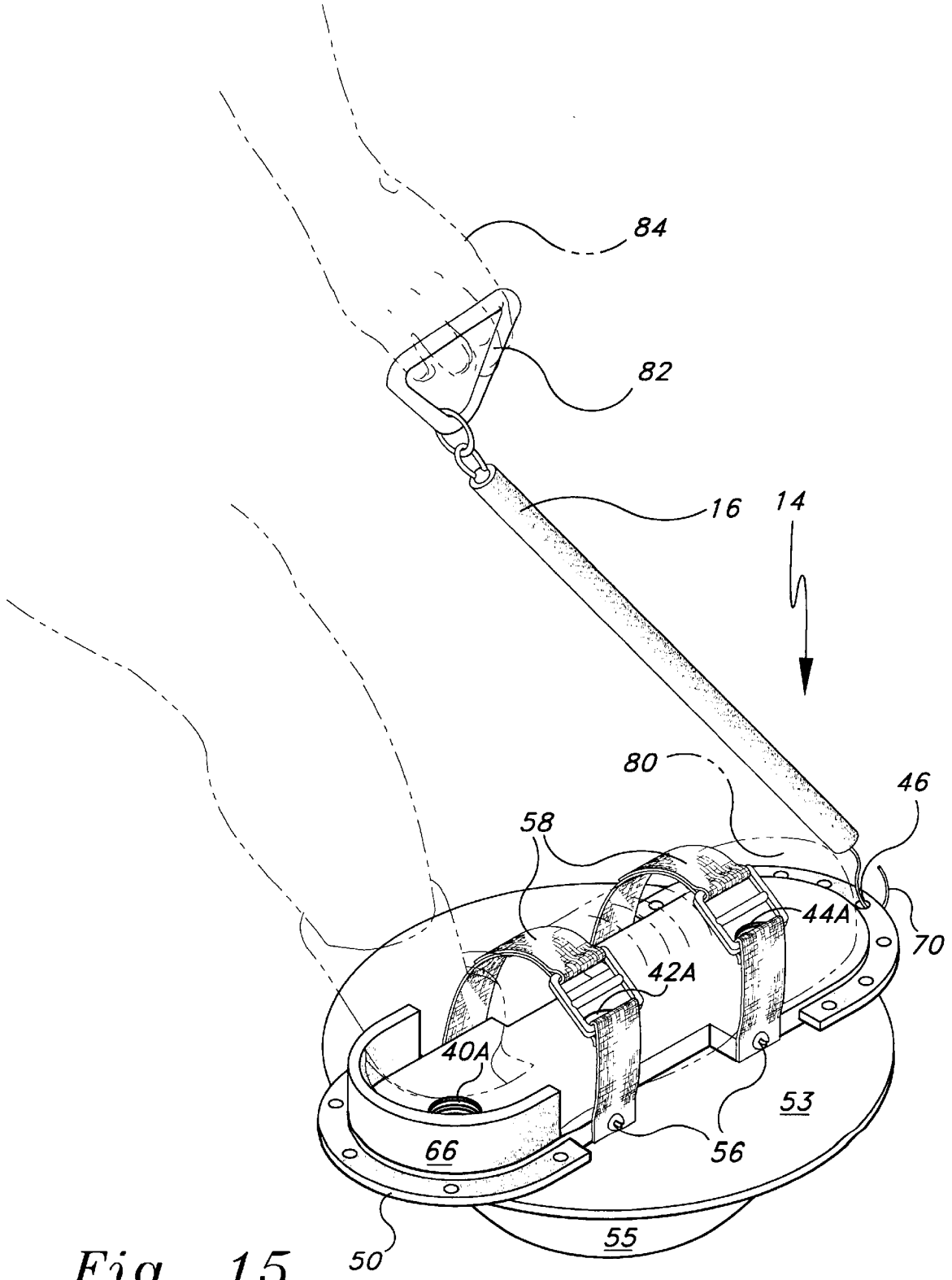
FIG. 15 is an environmental, perspective view of a third embodiment of an ankle and hip strengthening apparatus according to the present invention, showing plantar flexion exercises being performed via the attachment of the disc and ball support at a central location of the shoe according to the second embodiment.
Figure 16:
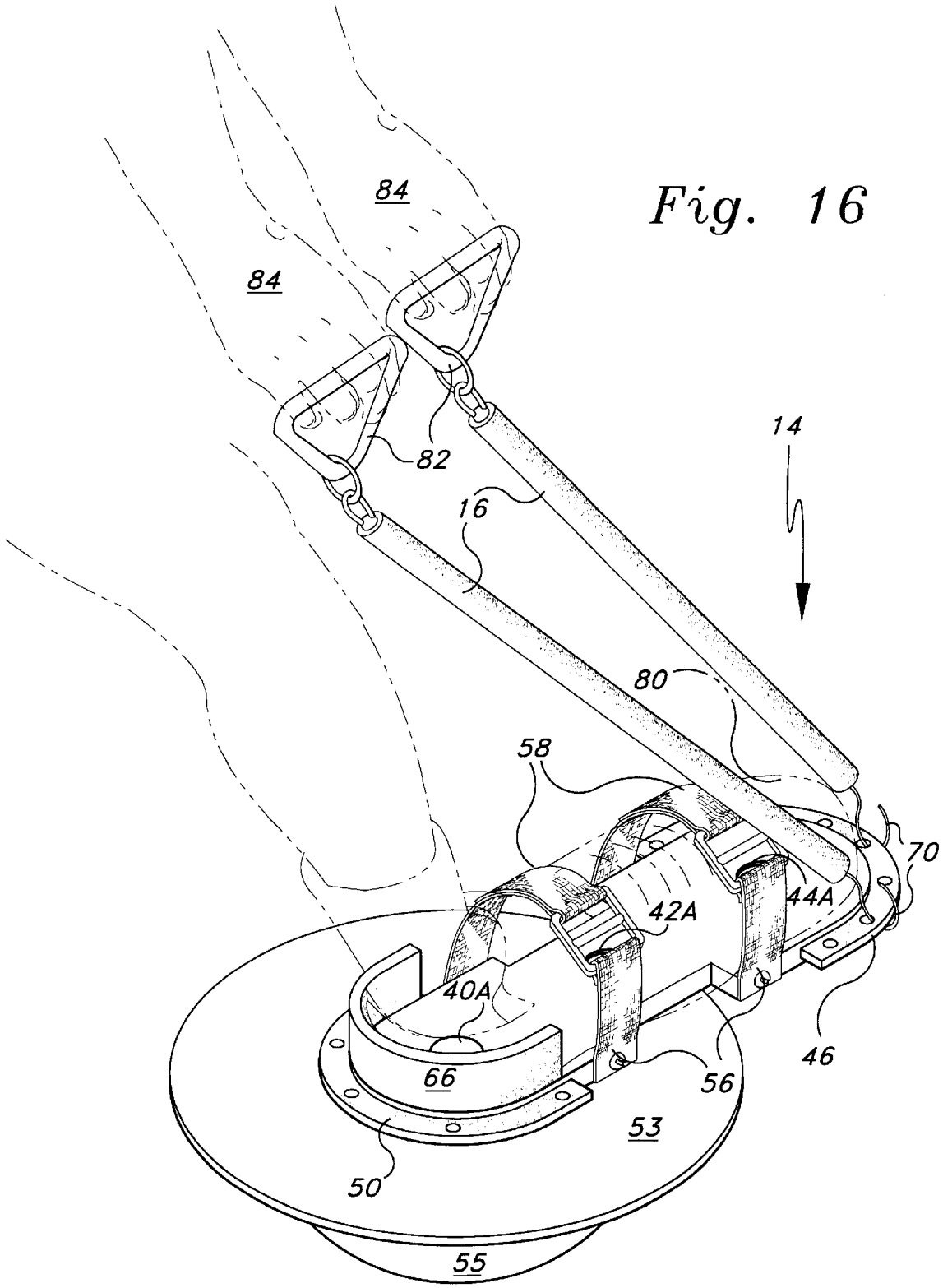
FIG. 16 is an environmental, perspective view of a third embodiment of an ankle and hip strengthening apparatus according to the present invention, showing plantar flexion exercises being performed against bidirectional resistance via the attachment of the disc and ball support at a rear or heel location of the shoe according to the second embodiment.

FIG. 15 illustrates the shoe 14 and surgical tubing 16 with handle 82 being used to perform plantar flexion exercises. Surgical tubing 16 is clipped to the front flange 46 of shoe 14 and to handle 82, so that flexing foot 80 downward stretches surgical tubing 16 between flange 46 and handle 82. Similarly, FIG. 16 illustrates plantar flexion exercises being performed against bidirectional resistance. The second surgical tubing 16, attached to the side of shoe 14 and to a second handle 82, will tend to rotate the outside edge of the foot 80 upward. The user attempts to perform the plantar flexion while not permitting such upward rotation, and while avoiding overcompensating for the second upward force. Such bidirectional resistance could of course be applied to the inside edge of the foot, and/or while performing dorsi flexion exercises.

Figure 18:
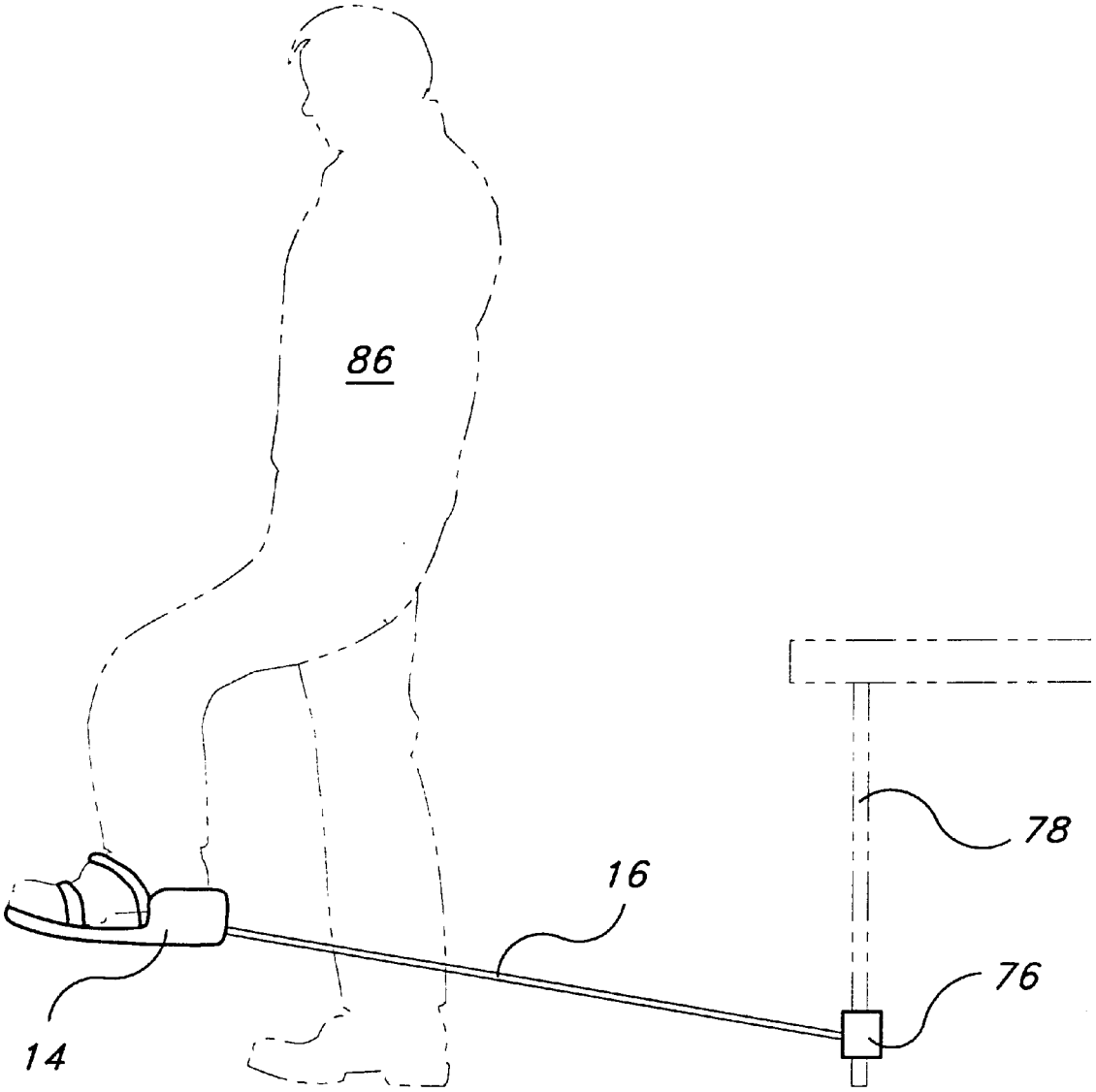
FIG. 18 is an environmental view of a third embodiment of an ankle and hip strengthening apparatus according to the present invention, showing a user performing hip flexion exercises.
Figure 19:
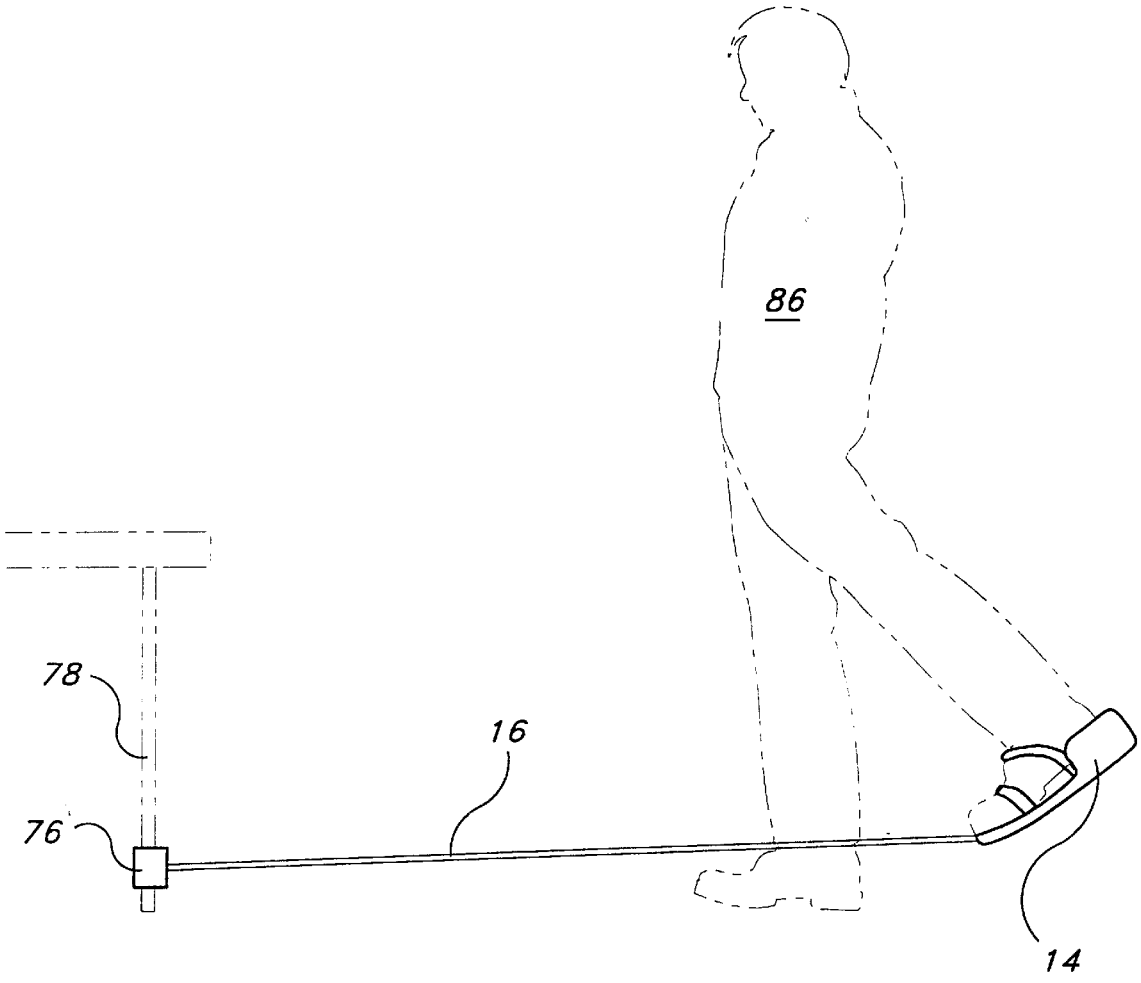
FIG. 19 is an environmental view of a third embodiment of an ankle and hip strengthening apparatus according to the present invention, showing a user performing hip extension exercises.

FIG. 18 illustrates a user 86 performing hip flexion exercises. Surgical tubing 16 is hooked or clipped to the flange 50 of shoe 14 and secured to strap 76, which is wrapped around a piece of furniture 78. The user 86 performs the exercise by raising his leg forward and upward, thereby stretching the surgical tubing 16. Similarly, FIG. 19 illustrates user 86 performing the opposing hip extension exercise. Surgical tubing 16 is clipped to front flange 46 of shoe 14 and to strap 76, which is wrapped around a piece of furniture 18, so that raising the leg rearward stretches the surgical tubing 16.

Figure 20:
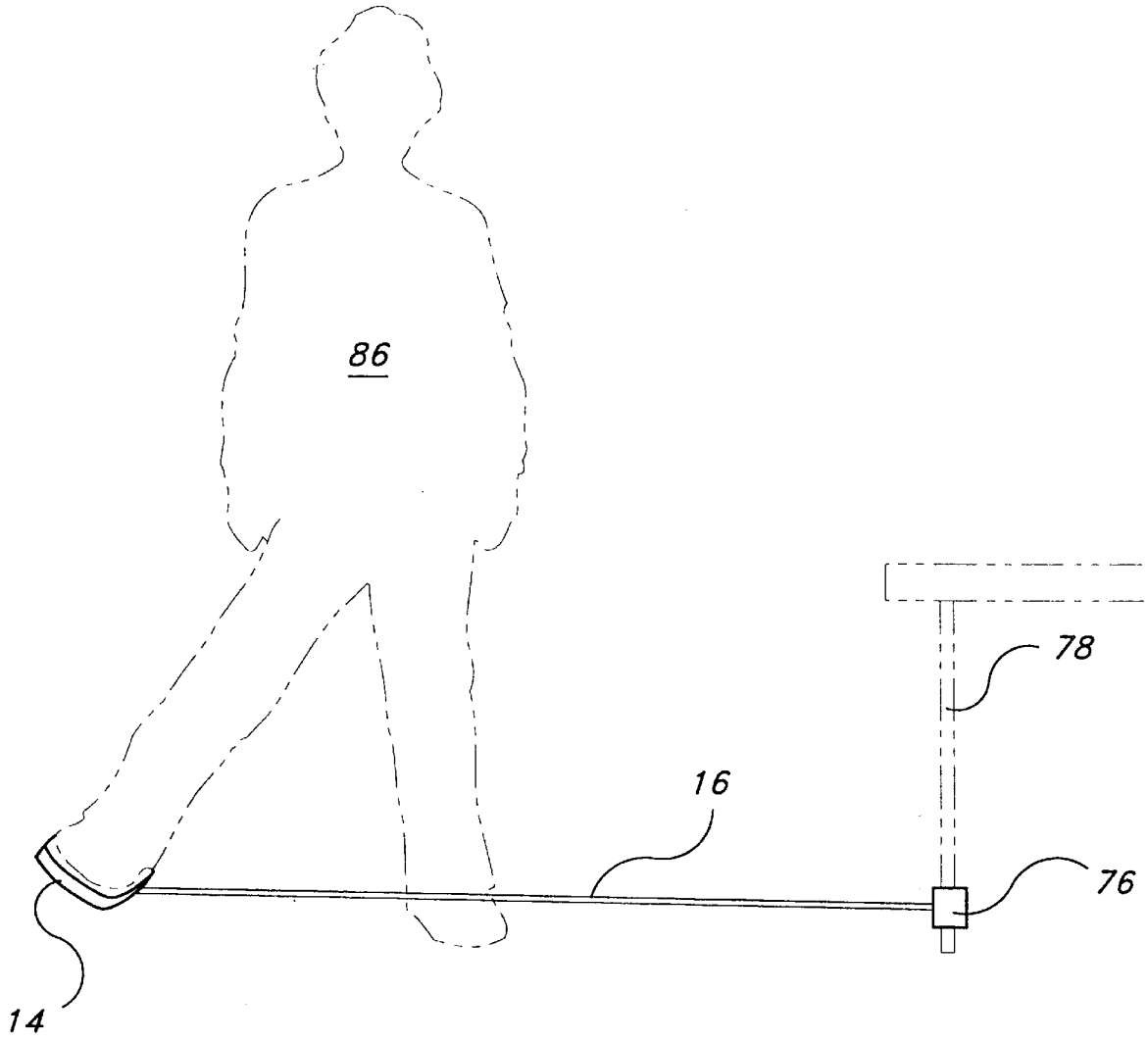
FIG. 20 is an environmental view of a third embodiment of an ankle and hip strengthening apparatus according to the present invention, showing a user performing abduction exercises.
Figure 21:
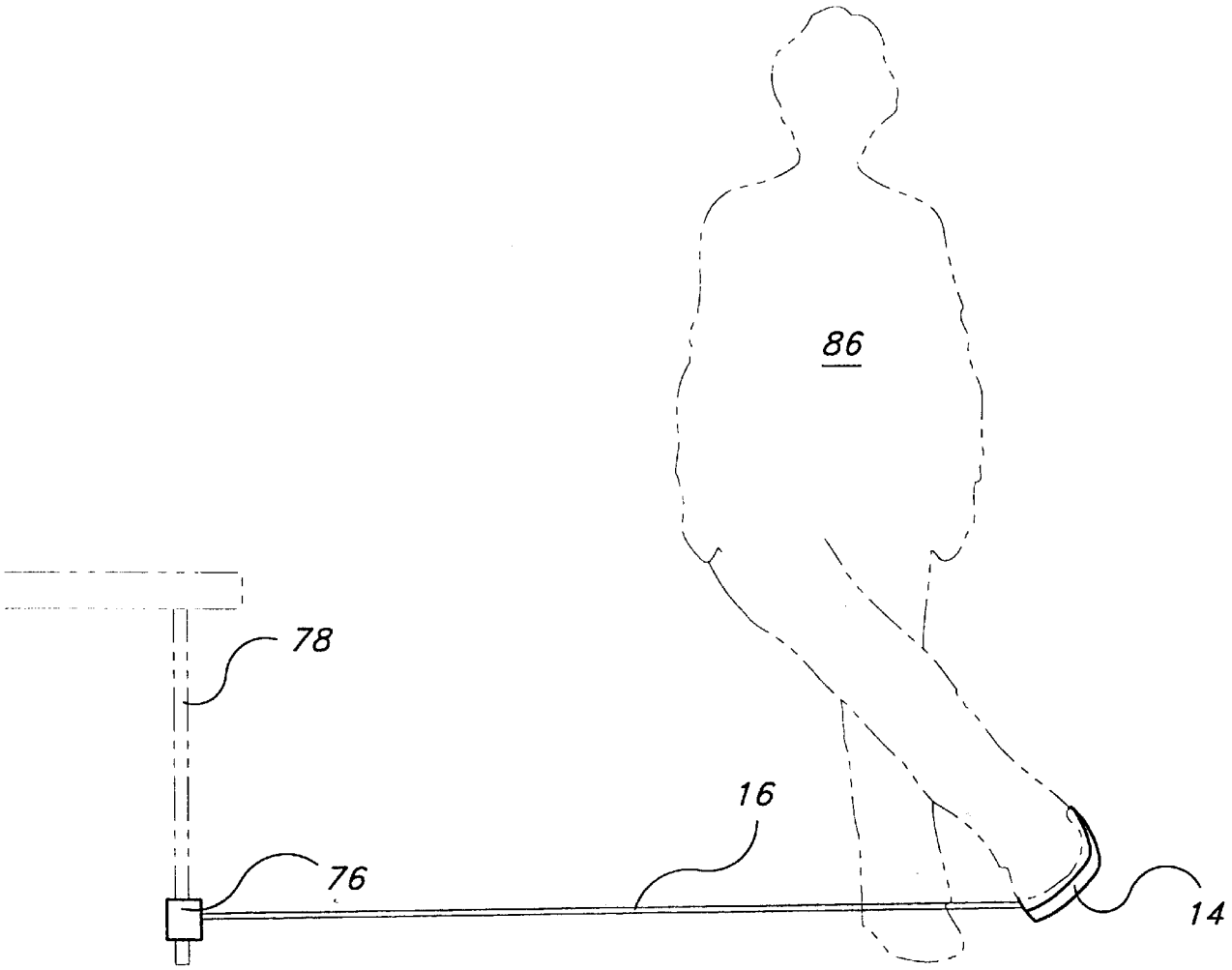
FIG. 21 is an environmental view of a third embodiment of an ankle and hip strengthening apparatus according to the present invention, showing a user performing adduction exercises.

FIG. 20 illustrates a user 86 performing abduction exercises. Surgical tubing 16 is clipped to the inside edge of shoe 14 and to strap 76, which is wrapped around a piece of furniture 78, so that raising one's leg outward to the opposite side stretches the surgical tubing 16. Similarly, FIG. 21 illustrates a user performing adduction exercises. Surgical tubing 16 is attached to the outside edge of shoe 14 and to strap 76, which is wrapped around a piece of furniture 78, so that raising one's leg inward stretches the surgical tubing.

Figure 22:
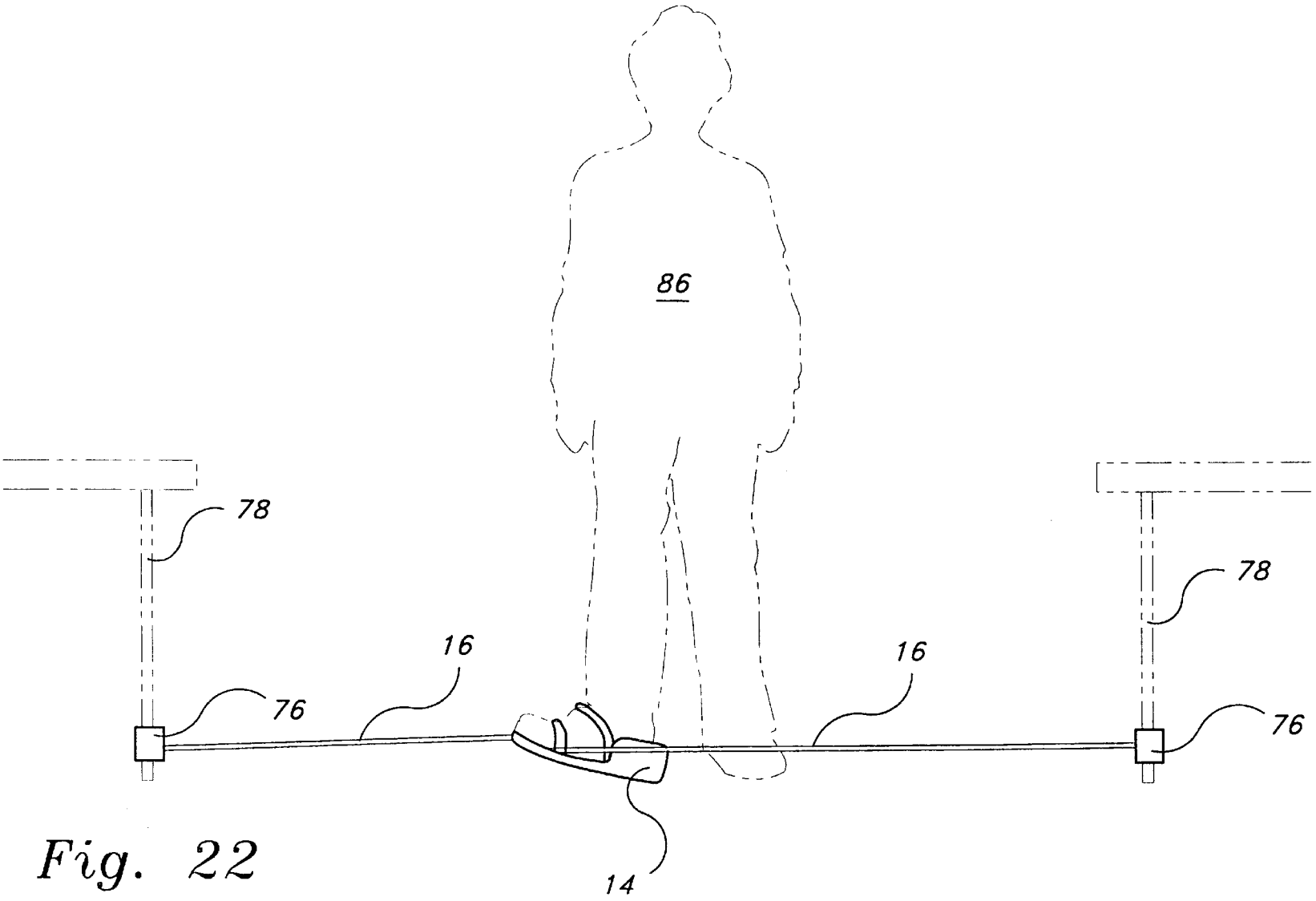
FIG. 22 is an environmental view of a third embodiment of an ankle and hip strengthening apparatus according to the present invention, showing a user performing hip rotation exercises against bidirectional resistance.

FIG. 22 illustrates a user 86 performing hip rotation exercises against bidirectional resistance. A pair of surgical tubings 16 attach at one end to shoe 14, each stretching in a different direction between shoe 14 and a piece of furniture 78. Rotating the hip, leg, and foot stretches the surgical tubing 16.

All of the above described figures illustrate resistance provided by a single elongated resistance member 16. It should be obvious that, if increased resistance is required, two or more parallel resistance members 16 may be used. Additionally, the use of multiple holes 48,52 defined within flanges 46,50 provides an additional means of varying the amount of resistance provided by a given elongated resistance member 16. The illustrations show the resistance members 16 attached to the hole 48,52 farthest from the peg 20,24, thereby maximizing the resistance arm of the lever (the resistance arm being the distance from peg 20,24 to hole 48,52) defined by the fulcrum at peg 20,24, resistance at hole 48,52, and effort (user's muscles). Attaching elastomeric resistance member 16 to a hole 48,52 closer to peg 20,24 will shorten the resistance arm, thereby reducing the amount of resistance supplied by elastomeric resistance member 16.

It will be obvious to those skilled in the art that there are many possible ways to configure the above apparatus to perform a wide variety of exercises, not all of which can be described here. Thus, it is to be understood that the present invention is not limited to the sole embodiments described above, but encompasses any and all embodiments within the scope of the following claims.

I claim:

1. An ankle and hip exercising apparatus, comprising:

an overshoe having a sole with a heel portion, center, and toe portion, said sole further having a top surface, a bottom surface, and an outer edge, said bottom surface having a concave hemispherical divot in the bottom surface of each of said toe portion, center, and heel portion, said divots being dimensioned and configured to cooperate with a hemispherical top of at least one peg, said top surface having a heel support, said overshoe further having a first flange extending outward from said outer edge at said toe portion, and a second flange extending outward from said outer edge at said heel portion, said first and second flanges each defining at least one hole, said overshoe further comprising at least one strap; and at least one elastomeric resistance member having a first end and a second end, said first end including means for attaching to said overshoe's flanges, said second end including means for anchoring said elastomeric resistance member.

2. The ankle and hip exercising apparatus according to claim 1, further comprising a base, said base having a board, at least one peg extending upward from said board, said peg having a top end with a hemispherical configuration.

3. The ankle and hip exercising apparatus according to claim 2, wherein said base further comprises at least one anchoring point.

4. The ankle and hip exercising apparatus according to claim 3, wherein said at least one anchoring point is an eyelet.

5. The ankle and hip exercising apparatus according to claim 4, wherein said eyelet is a screw-in type eyelet.

6. The ankle and hip exercising apparatus according to claim 2, wherein said base further comprises ankle measurement indicia.

7. The ankle and hip exercising apparatus according to claim 2, wherein said board has a semicircular configuration.

8. The ankle and hip exercising apparatus according to claim 2, wherein said board has a circular configuration.

9. The ankle and hip exercising apparatus according to claim 1, wherein said overshoe's at least one strap includes a buckle.

10. The ankle and hip exercising apparatus according to claim 9, further comprising a strap including mating hook and loop fasteners, said strap including hook and loop fasteners being dimensioned and configured to fit within said buckle.

11. The ankle and hip exercising apparatus according to claim 1, wherein said overshoe's at least one strap includes hook and loop fasteners.

12. The ankle and hip exercising apparatus according to claim 1, wherein said overshoe's at least one strap attaches to said outer edge.

13. The ankle and hip exercising apparatus according to claim 1, wherein said overshoe's at least one strap attaches to said sole by means of a screw.

14. The ankle and hip exercising apparatus according to claim 1, wherein said elastomeric resistance member's means for attaching to said overshoe's flanges is a hook.

15. The ankle and hip exercising apparatus according to claim 4, wherein said elastomeric resistance member's means for anchoring is a clip.

16. The ankle and hip exercising apparatus according to claim 1, wherein said elastomeric resistance member is surgical tubing.

17. The ankle and hip exercising apparatus according to claim 1, wherein said elastomeric resistance member's means for anchoring includes a strap having mating hook and loop fasteners.

18. The ankle and hip exercising apparatus according to claim 17, wherein said strap includes a ring.

19. An ankle and hip exercising apparatus, comprising:

an overshoe having a sole with a heel portion, center, and toe portion, said sole further having a top surface, a bottom surface, and an outer edge, said bottom surface having a concave hemispherical divot in the bottom surface of each of said toe portion, center, and heel portion, said divots being dimensioned and configured to cooperate with a hemispherical top of at least one peg, said top surface having a heel support, said overshoe further having a first flange extending outward from said outer edge at said toe portion, and a second flange extending outward from said outer edge at said heel portion, said first and second flanges each defining at least one hole, said overshoe further comprising at least one strap;

at least one elastomeric resistance member having a first end and a second end, said first end including means for attaching to said overshoe's flanges, said second end including means for anchoring said elastomeric resistance member;

a combination disc and ball support for attachment with the sole at selective positions, wherein said sole further comprises a plurality of linearly disposed attachment means for threadedly and selectively attaching said combination support thereto.

20. The ankle and hip exercising apparatus according to claim 19, wherein said elastomeric resistance member's means for anchoring includes a strap having mating hook and loop fasteners.

* * * * *